US011029616B2

(12) United States Patent
Kujirai et al.

(10) Patent No.: US 11,029,616 B2
(45) Date of Patent: Jun. 8, 2021

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Shubun Kujirai, Toride (JP); Koichi Nakata, Tokyo (JP); Haruki Mori, Nagareyama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/894,977

(22) Filed: Jun. 8, 2020

(65) Prior Publication Data

US 2020/0393775 A1 Dec. 17, 2020

(30) Foreign Application Priority Data

Jun. 13, 2019 (JP) ..... JP2019-110642

(51) Int. Cl.

| | |
|---|---|
| ***G03G 5/147*** | (2006.01) |
| ***G03G 5/07*** | (2006.01) |
| ***G03G 21/18*** | (2006.01) |
| ***G03G 15/00*** | (2006.01) |

(52) U.S. Cl.

CPC ..... *G03G 5/0732* (2020.05); *G03G 5/14734* (2013.01); *G03G 15/75* (2013.01); *G03G 21/1803* (2013.01)

(58) Field of Classification Search

CPC ..... G03G 5/147; G03G 5/14708; G03G 5/14713; G03G 5/14717; G03G 5/14726; G03G 5/14786

See application file for complete search history.

(56) References Cited

U.S. PATENT DOCUMENTS

| | | | |
|---|---|---|---|
| 7,186,489 | B2 | 3/2007 | Uematsu et al. |
| 7,226,711 | B2 | 6/2007 | Amamiya et al. |
| 7,534,534 | B2 | 5/2009 | Nakata et al. |
| 9,316,931 | B2 | 4/2016 | Takagi et al. |
| 9,389,523 | B2 | 7/2016 | Nakata et al. |
| 9,594,318 | B2 | 3/2017 | Nakata et al. |
| 9,740,117 | B2 | 8/2017 | Kosaka et al. |
| 10,042,272 | B2 | 8/2018 | Mori et al. |
| 10,120,331 | B2 | 11/2018 | Nakata et al. |

(Continued)

FOREIGN PATENT DOCUMENTS

| | | | | |
|---|---|---|---|---|
| JP | 06-308756 | * | 11/1994 | ..... G03G 5/147 |
| JP | 2000-206724 | * | 7/2000 | ..... G03G 5/147 |

(Continued)

OTHER PUBLICATIONS

Translation of JP 2000-206724.*

(Continued)

*Primary Examiner* — Peter L Vajda

(74) *Attorney, Agent, or Firm* — Venable LLP

(57) ABSTRACT

An electrophotographic photosensitive member including: a support; and a surface layer, wherein the surface layer contains a cured product of a composition containing a curable hole-transport compound, a specific fluorine-atom-containing compound, and a specific polymerizable compound.

11 Claims, 4 Drawing Sheets

(56) References Cited

U.S. PATENT DOCUMENTS

| | | | |
|---|---|---|---|
| 10,310,395 | B2 | 6/2019 | Nakata et al. |
| 10,365,569 | B2 | 7/2019 | Tokimitsu et al. |
| 10,451,984 | B2 | 10/2019 | Mori et al. |
| 10,488,769 | B2 | 11/2019 | Nakata et al. |
| 10,488,771 | B2 | 11/2019 | Mori et al. |
| 10,558,132 | B2 | 2/2020 | Ishiduka et al. |
| 10,558,133 | B2 | 2/2020 | Nakamura et al. |
| 10,670,979 | B2 | 6/2020 | Nakata et al. |
| 10,761,442 | B2 | 9/2020 | Nakata et al. |
| 10,768,539 | B2 | 9/2020 | Mori et al. |
| 2019/0369514 | A1 | 12/2019 | Watanabe et al. |
| 2020/0159136 | A1 | 5/2020 | Mori et al. |
| 2020/0201200 | A1 | 6/2020 | Tokimitsu et al. |
| 2020/0218171 | A1 | 7/2020 | Takeuchi et al. |
| 2020/0249590 | A1 | 8/2020 | Nakata et al. |

FOREIGN PATENT DOCUMENTS

| | | |
|---|---|---|
| JP | 2006-058822 | 3/2006 |
| JP | 2009-134002 | 6/2009 |
| JP | 4585930 | 11/2010 |

OTHER PUBLICATIONS

Translation of JP 06-308756.*
U.S. Appl. No. 16/855,022, Kenichi Ikari, filed Apr. 22, 2020.
U.S. Appl. No. 16/855,035, Ryoichi Tokimitsu, filed Apr. 22, 2020.
U.S. Appl. No. 16/894,988, Eileen Takeuchi, filed Jun. 8, 2020.
U.S. Appl. No. 16/936,508, Takahiro Mitsui, filed Jul. 23, 2020.
U.S. Appl. No. 16/936,642, Mai Kaku, filed Jul. 23, 2020.
U.S. Appl. No. 17/082,610, Haruki Mori, filed Oct. 28, 2020.

* cited by examiner

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

Field of the Invention

The present invention relates to an electrophotographic photosensitive member, a process cartridge including the electrophotographic photosensitive member, and an electrophotographic apparatus including the electrophotographic photosensitive member.

Description of the Related Art

As photoelectric conductive materials used for producing an electrophotographic photosensitive member, inorganic materials such as selenium, cadmium sulfide, and zinc oxide have been known previously. On the other hand, polyvinylcarbazole, phthalocyanine, azo pigments, and the like, which are organic materials, attract attention due to their advantageous properties such as high productivity, nonpolluting properties, and the like. Thus, although there is a tendency that such organic materials are inferior to inorganic materials in photoconductive properties, durability, and the like, the organic materials are becoming widely used. Since electrophotographic photosensitive members produced by using these organic materials have both satisfactory electrical and mechanical properties, the electrophotographic photosensitive members often used as function-separated electrophotographic photosensitive members in which a charge generating layer and a hole transport layer are laminated.

On the other hand, of course, the electrophotographic photosensitive member is required to have sensitivity, electrical properties, and optical properties suitable for electrophotographic processes in which the electrophotographic photosensitive member is used. Particularly, in a repeatedly used electrophotographic photosensitive member, since electrical and mechanical external forces such as electrical charging, image exposure, toner development, transfer to paper, and cleaning treatment are directly applied to the surface of the electrophotographic photosensitive member, durability and stability against such external forces are required. Specifically, surface-wear and surface-scratch resistance against abrasion, and surface-deterioration resistance against ozone, which is produced by electrical charge, and discharge products such as nitrogen oxide are required. In addition, for achieving an ability for preventing toner adhesion to an electrophotographic photosensitive member, for achieving an excellent cleanability, and for imparting transferability to an electrophotographic photosensitive member, lowering of the surface energy of an electrophotographic photosensitive member is required.

As an example of the lowering of the surface energy of an electrophotographic photosensitive member, it is proposed to use fluorine-atom-containing compounds for forming a surface layer.

However, when a fluorine-based material such as fluorine-based oil is included in a surface layer, the hardness of the surface layer may decrease, the fluorine-based material which has been transferred to the surface may exude, uneven coating of a lower layer for applying a coating liquid for the surface layer may occur, and the surface layer may be repelled starting from deposits, aggregates, or the like.

For solving the above-described problems, a method for forming a surface layer by curing a curable hole-transport compound monomer and a monomer that has 2 or more reactive functional groups and a fluorine atom has been proposed.

Japanese Patent No. 4585930 discloses that an electrophotographic photosensitive member having a surface layer formed by curing a curable hole-transport compound monomer and a monomer that has 2 or more reactive functional groups and a fluorine atom has been proposed.

The present inventors have made investigations on the electrophotographic photosensitive member described in Japanese Patent No. 4585930 and found that when the electrophotographic photosensitive member is installed in a copying machine and used for a long time, thereafter the copying machine is stopped for a certain time, and then operated again to form an image, unevenness is sometimes formed in the image.

Accordingly, an object of the present invention is to provide an electrophotographic photosensitive member that can reduce unevenness formed in an image during long-time use.

SUMMARY OF THE INVENTION

The above-described object can be accomplished by the present invention as described below. That is, an electrophotographic photosensitive member according to one aspect of the present invention is an electrophotographic photosensitive member including: a support; and a surface layer, wherein the surface layer contains: a cured product of a composition containing a curable hole-transport compound; a compound represented by the following formula (1); and a compound represented by the following formula (2).

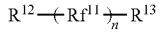

(1)

In formula (1), $Rf^{11}$ represents a divalent group having 3 or more carbon atoms and 6 or more fluorine atoms. $R^{12}$ and $R^{13}$ each independently represent a hydrogen atom, a fluorine atom, an acryloyloxy group, or a methacryloyloxy group. With the proviso, however, that at least one of $R^{12}$ and $R^{13}$ is an acryloyloxy group or a methacryloyloxy group.

(2)

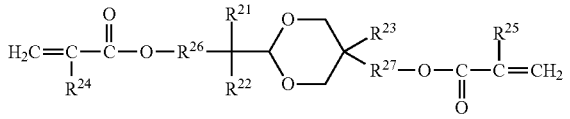

In formula (2), $R^{21}$ and $R^{22}$ each independently represent an alkyl group having 1 or more and 4 or less carbon atoms, or a substituted or unsubstituted aryl group having 1 or more and 4 or less carbon atoms. The substituent, which can be a substituent of the aryl group, is an alkyl group having 1 or more and 4 or less carbon atoms. $R^{21}$ and $R^{22}$ may be joined together to form a ring. $R^{23}$ represents an alkyl group having 1 or more and 4 or less carbon atoms. $R^{24}$ and $R^{25}$ each independently represent a hydrogen atom or a methyl group. $R^{26}$ and $R^{27}$ each independently represent an alkylene group having 1 or more and 4 or less carbon atoms.

A process cartridge according to another aspect of the present invention is characterized in that the process cartridge is detachably attachable to an electrophotographic apparatus main body, and integrally supports: the above-described electrophotographic photosensitive member; and at least one unit selected from the group consisting of a charging unit, a developing unit, a transfer unit, and a cleaning unit.

An electrophotographic apparatus according to still another aspect of the present invention is characterized in that the electrophotographic apparatus includes: the above-described electrophotographic photosensitive member; and a charging unit, an exposing unit, a developing unit, and a transfer unit.

Further features of the present invention will become apparent from the following description of exemplary embodiments with reference to the attached drawings.

DESCRIPTION OF THE EMBODIMENTS

Figure 1:
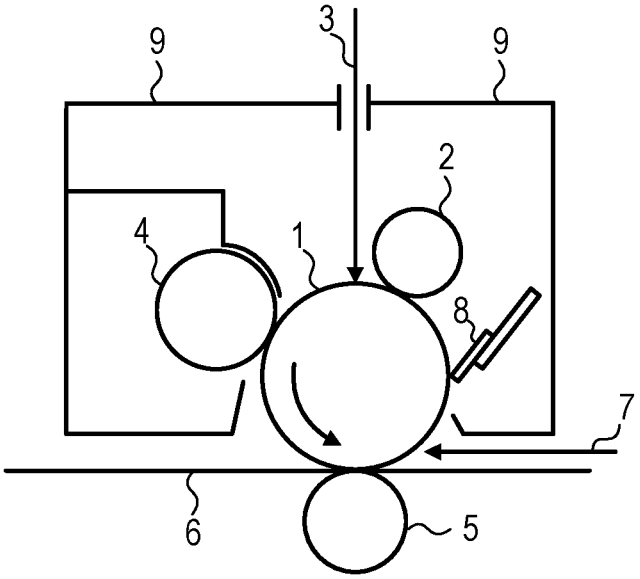
FIG. 1 is a schematic diagram illustrating an example of a process cartridge including an electrophotographic photosensitive member.

The present invention is described in detail below with reference to preferred embodiments.

The present inventors have examined the technique described in Japanese Patent No. 4585930 as follows. An electrophotographic photosensitive member was installed in a copying machine and used for a long time, thereafter the copying machine was stopped for a certain time, and then operated again to form an image. As a result, unevenness was formed in the image.

The surface layer of the electrophotographic photosensitive member described in Japanese Patent No. 4585930 has a structure derived from a monomer including a fluorine atom. The monomer including a fluorine atom has a large molecular volume as compared to a monomer with no fluorine atom. Thus, it is thought that the surface layer having a structure derived from a monomer including a fluorine atom has a decreased fineness. When the surface layer has a decreased fineness, a discharge product easily intrudes and deterioration of an electrophotographic photosensitive member tends to progress. It is though that the unevenness was formed consequently.

For solving the problems in the prior art, the present inventors have made investigations on new species of materials to be added.

As a result, it is found that when a surface layer includes a cured product of a composition containing a curable hole-transport compound, a compound represented by the following formula (1) and a compound represented by the following formula (2), the formation of unevenness in an image can be prevented.

$$R^{12}-(Rf^{11})_n-R^{13} \quad (1)$$

In formula (1), $Rf^{11}$ represents a divalent group having 3 or more carbon atoms and 6 or more fluorine atoms. $R^{12}$ and $R^{13}$ each independently represent a hydrogen atom, a fluorine atom, an acryloyloxy group, or a methacryloyloxy group. With the proviso, however, that at least one of $R^{12}$ and $R^{13}$ is an acryloyloxy group or a methacryloyloxy group.

(2)

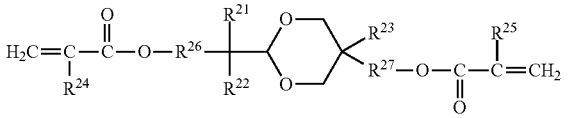

In formula (2), $R^{21}$ and $R^{22}$ each independently represent an alkyl group having 1 or more and 4 or less carbon atoms, or a substituted or unsubstituted aryl group having 1 or more and 4 or less carbon atoms. The substituent, which can be a substituent of the aryl group, is an alkyl group having 1 or more and 4 or less carbon atoms. $R^{21}$ and $R^{22}$ may be joined together to form a ring. $R^{23}$ represents an alkyl group having 1 or more and 4 or less carbon atoms. $R^{24}$ and $R^{25}$ each independently represent a hydrogen atom or a methyl group. $R^{26}$ and $R^{27}$ each independently represent an alkylene group having 1 or more and 4 or less carbon atoms.

The present inventors assumed that the mechanism for achieving the effect of preventing the formation of unevenness in an image according to the present invention is as follows.

Characteristic features of the present invention are the following two features. One of the features is that each of the three compounds, which are a curable hole-transport compound, a compound represented by formula (1), and a compound represented by formula (2), used for forming the surface layer has a specific copolymerizable functional group which can contribute to copolymerization. The other one of the features is that the compound represented by the formula (2) has an appropriately small molecular weight as compared to the curable hole-transport compound. Depending on these features, a copolymer of the above-described three compounds has a small intermolecular distance as compared to a cured material obtained by copolymerization of merely the curable hole-transport compound and a monomer having a fluorine atom. That is, a surface layer including the copolymer of the above-described three compounds has a fineness and improved gas barrier properties. Thus, deterioration of the electrophotographic photosensitive member by a discharge product can be prevented, and an effect of suppressing the formation of unevenness in an image can be achieved.

A smaller molecular weight of the compound represented by the formula (2) is better for reducing the intermolecular distance in the copolymer of the above-described three compounds. However, when the molecular weight is too small, the copolymerization is impossible and the effect of the present invention cannot be achieved. The present invention achieves the effect of the present invention by selecting a suitable combination of three compounds and copolymerizing the three compounds.

Constituent materials are each described in detail below.

(Compound Represented by Formula (1))

The compound represented by the formula (1) is preferably a compound represented by the following formula (3) or a compound represented by the following formula (4).

$$(R^{34})-(R^{32})-(Rf^{31})-(R^{33})-(R^{35}) \quad (3)$$

In formula (3), $Rf^{31}$ represents a group in which 6 or more hydrogen atoms in an alkylene group are each substituted with a fluorine atom. $R^{32}$ and $R^{33}$ represent an alkylene group or a phenylene group. $R^{34}$ and $R^{35}$ represent a hydrogen atom, a fluorine atom, a group represented by the following formula (5), or a group represented by the following formula (6). With the proviso, however, that at least one of $R^{34}$ and $R^{35}$ is a group represented by the following formula (5) or a group represented by the following formula (6).

$$R^{44})-(Rf^{42})-(R^{41})-(Rf^{43})-(R^{45}) \quad (4)$$

In formula (4), $R^{41}$ represents an alkylene group or a phenylene group. $Rf^{42}$ and $Rf^{13}$ each represent a group in which 3 or more hydrogen atoms in an alkylene group are each substituted with a fluorine atom. $R^{44}$ and $R^{45}$ represent a hydrogen atom, a fluorine atom, a group represented by the following formula (5), or a group represented by the following formula (6). With the proviso, however, that at least one of $R^{44}$ and $R^{45}$ is a group represented by the following formula (5) or a group represented by the following formula (6).

(5)

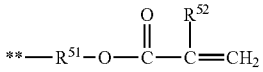

In formula (5), the symbol ** represents a position at which the group is bonded to each of the above-described $R^{32}$, $R^{33}$, $R^{42}$, and $R^{43}$. $R^{51}$ represents a single bond or an alkylene group having 1 or more and 6 or less carbon atoms. $R^{52}$ represents a hydrogen atom or a methyl group.

(6)

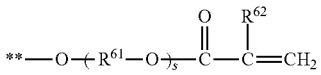

In formula (6), the symbol ** represents a position at which the group is bonded to the above-described $R^{32}$, $R^{33}$, $R^{42}$, and $R^{43}$. $R^{61}$ represents an alkylene group having 1 or more and 6 or less carbon atoms. $R^{62}$ represents a hydrogen atom or a methyl group. The subscript s represents an integer of 0 or more and 4 or less.

The content of the compound represented by the formula (1) in a composition for obtaining a cured product included in a surface layer preferably satisfies the following condition.

That is, in the above-described composition, when the mass of the curable hole-transport compound is denoted by A, the mass of the compound represented by the formula (1) is denoted by B, and the mass of the compound represented by the above-described formula (2) is denoted by C, a ratio of B, which is the mass of the compound represented by the above-described formula (1), to the sum total of A, B, and C, which is also represented as B/(A+B+C), is preferably 0.1 or more and 0.2 or less.

When B/(A+B+C) is 0.1 or more, water repellency of the surface of the electrophotographic photosensitive member is high, and the occurrence of image deletion under a high-temperature and high-humidity environment can be highly suppressed. On the other hand, when B/(A+B+C) is 0.2 or less, the surface layer of the electrophotographic photosensitive member has a high fineness, and the occurrence of unevenness in an image can be further effectively prevented.

The content of the compound represented by the formula (1) in a surface layer is preferably 10% or more and 20% or less on a mass basis.

Examples of the compound represented by the formula (1) are provided below. However, the compound is not limited to the following examples. In the following examples, X each independently represents a hydrogen atom, a fluorine atom, an acryloyloxy group, or a methacryloyloxy group.

(1-1)

$$X-CH_2CF_2CF_2CF_2CF_2CH_2-X$$

(1-2)

$$X-CH_2CF_2CF_2CF_2CF_2CF_2CF_2CH_2-X$$

(1-3)

$$X-CH_2CF_2CF_2CF_2CF_2CF_2CF_2CF_2CF_2CH_2-X$$

(1-4)

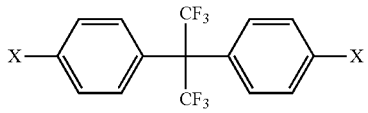

(1-5)

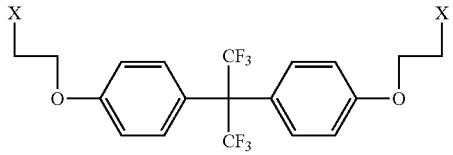

(1-6)

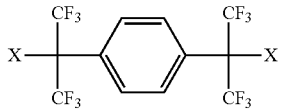

(1-7)

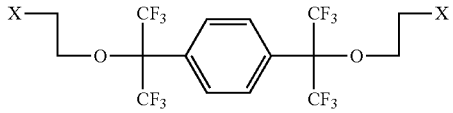

(1-8)

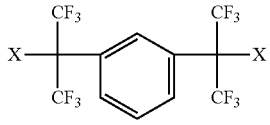

(1-9)

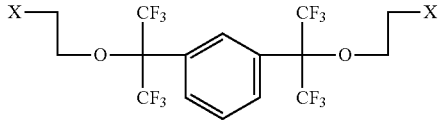

-continued (1-10)

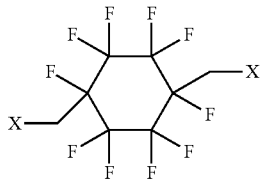

(1-11)

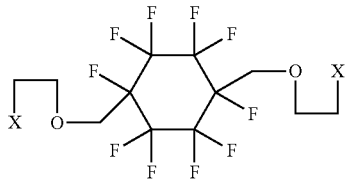

(1-12)

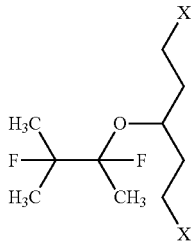

(1-13)

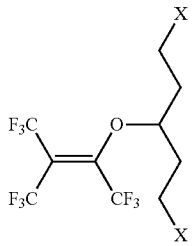

(1-14)

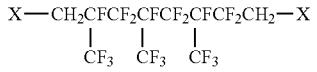

(1-15)

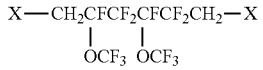

Among these, from the standpoint of suppressing the occurrence of image deletion, a compound represented by the formula (1-1), a compound represented by the formula (1-2), a compound represented by the formula (1-3), a compound represented by the formula (1-4), and a compound represented by the formula (1-5) are particularly preferred.

(Compound Represented by Formula (2))

The compound represented by the formula (2) is a polymerizable monomer having an acetal ring in the molecule and has an acryloyloxy group or a methacryloyloxy group at an end of the molecule.

The compound represented by the formula (2) does not have hole transport properties. When the compound represented by the formula (2) is used concurrently with a curable hole-transport compound and a compound represented by the formula (1), a well-balanced suppression of the occurrence of image deletion under a high-temperature and high-humidity environment, fluctuations in electrical potential under a low-temperature and low-humidity environment, and the formation of unevenness in an image during long-time use can be achieved.

The present inventors speculate that the compound represented by the formula (2) has an appropriately small molecular weight, thus contributes to improvement in fineness of the surface layer of an electrophotographic photosensitive member, which results in an effect of preventing intrusion of water from the environment into the electrophotographic photosensitive member. The compound represented by the formula (2) not only has an appropriately small molecular weight, but also has a polymerizable functional group. This leads to results that the network of a copolymer of a curable hole-transport compound and a compound represented by the formula (1) becomes dense, the strength of the surface layer is increased, and thus the durability of the electrophotographic photosensitive member is improved.

In the formula (2), $R^{21}$ and $R^{22}$ each independently represent an alkyl group having 1 or more and 4 or less carbon atoms, or a substituted or unsubstituted aryl group having 1 or more and 4 or less carbon atoms. Examples of the substituent, which can be a substituent of the aryl group, include an alkyl group having 4 or less carbon atoms, such as a methyl group, an ethyl group, an n-propyl group, an isopropyl group, an n-butyl group, an isobutyl group, a sec-butyl group, and a tert-butyl group.

$R^{21}$ and $R^{22}$ are each preferably an alkyl group having 1 to 4 carbon atoms. When $R^{21}$ and $R^{22}$ are each an alkyl group having 1 to 4 carbon atoms, the compound represented by the formula (2) has an appropriately small molecular weight, and thus can further improve fineness of the surface layer.

$R^{21}$ and $R^{22}$ may be joined together to form a ring. Examples of the ring formed include a cyclopentane ring, a cyclohexane ring, and a cycloheptane ring.

$R^{23}$ is an alkyl group having 1 or more and 4 or less carbon atoms. From the standpoint of improving the effect of the present invention, $R^{23}$ is preferably a methyl group or an ethyl group.

From the standpoint of wear resistance of the surface layer and the standpoint of a polymerization reaction rate during polymerization, the polymerizable functional group in the compound represented by the formula (2) is an acryloyloxy group or a methacryloyloxy group. Thus, $R^{24}$ and $R^{25}$ each represent a hydrogen atom or a methyl group.

The content of the compound represented by the formula (2) in a composition for obtaining a cured product included in a surface layer preferably satisfies the following condition.

That is, in the above-described composition, when the mass of the curable hole-transport compound is denoted by A, the mass of the compound represented by the formula (1) is denoted by B, and the mass of the compound represented by the formula (2) is denoted by C, a ratio of C, which is the mass of the compound represented by the formula (2), to the sum total of A, B, and C, which is also represented as C/(A+B+C), is preferably 0.1 or more and 0.2 or less.

When C/(A+B+C) is 0.1 or more, fineness of the surface layer of the electrophotographic photosensitive member is high, which leads to an improved gas barrier properties. As a result, the formation of unevenness in an image can be further effectively prevented. On the other hand, when C/(A+B+C) is 0.2 or less, hole transport properties as the surface layer of the electrophotographic photosensitive member are not damaged, and deterioration of electrical properties can be prevented.

The content of the compound represented by the formula (2) in a surface layer is preferably 10% or more and 20% or less on a mass basis.

In an infrared spectrum obtained for the surface layer of the electrophotographic photosensitive member, when the maximum value of peak height within the wavenumber range of from 1100 $cm^{-1}$ to 1125 $cm^{-1}$ is denoted by D and the maximum value of peak height within the wavenumber range of from 1700 $cm^{-1}$ to 1770 $cm^{-1}$ is denoted by E, a ratio of D to E, which is D/E, is preferably 0.30 or more and 0.45 or less.

The peaks within the wavenumber range of 1100 $cm^{-1}$ to 1125 $cm^{-1}$ are included in a specific absorption band derived from the compound represented by the formula (2). The peaks within the wavenumber range of 1700 $cm^{-1}$ to 1770 $cm^{-1}$ are included in a specific absorption band derived from carbonyl groups (C=0) of the (meth) acryloyloxy groups in the compound represented by the formula (1) and the compound represented by the formula (2). The ratio between the maximum values of these peaks D/E relates to the amount of the compound represented by the formula (2) present in a film of the surface layer of the electrophotographic photosensitive member.

When the value of the ratio D/E is 0.30 or more and 0.45 or less, specific properties of the present invention can be imparted to the electrophotographic photosensitive member.

The infrared spectrum can be measured as follows. A portion of the surface layer of an electrophotographic photosensitive member including the outmost layer is obtained by peeling off or the like, and measured by an attenuated total reflection (ATR) spectroscopy. Thus, an infrared absorption spectrum of only the surface layer can be measured. The thickness of the layer to be measured for the absorption spectrum depends on types of materials of the prism. When a germanium prism is used, a portion of less than 1 μm from the surface is used.

Examples of the compound represented by the formula (2) are provided below. However, the compound is not limited to the following examples.

(2-1)

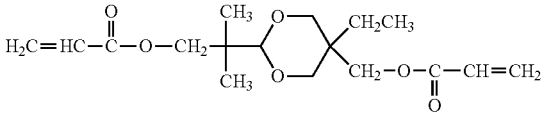

(2-2)

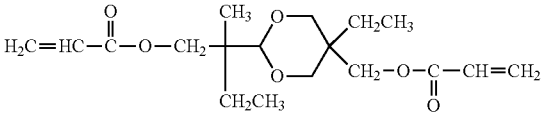

(2-3)

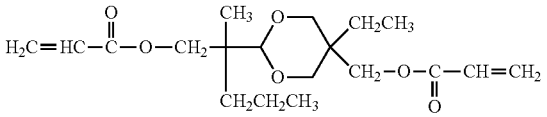

(2-4)

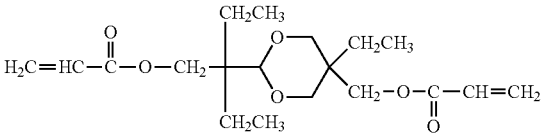

(2-5)

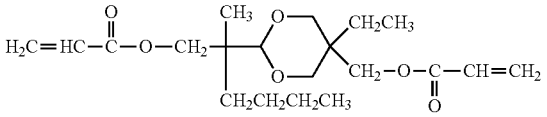

(2-6)

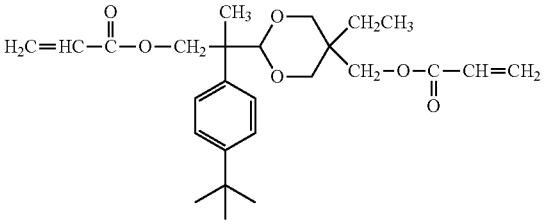

(2-7)

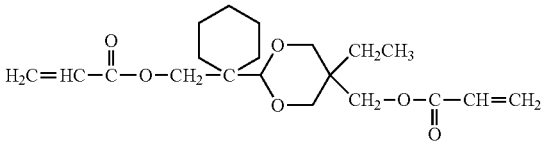

(2-8)

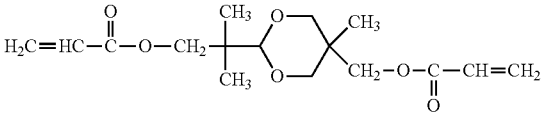

(2-9)

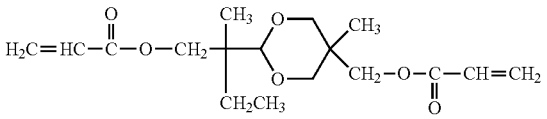

(2-10)

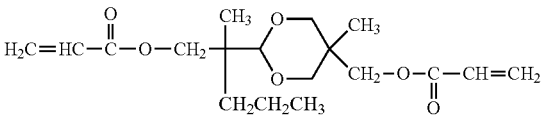

(2-11)

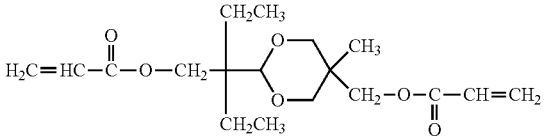

(2-12)

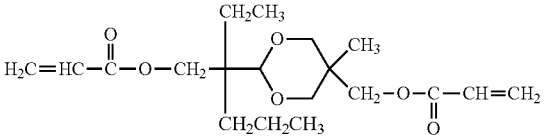

-continued (2-13)

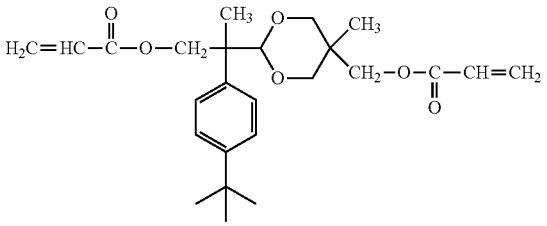

(2-14)

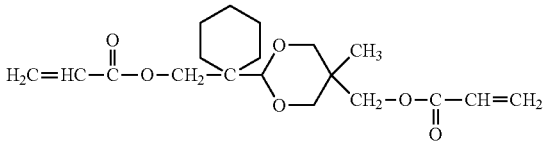

(2-15)

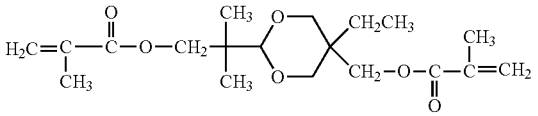

(2-16)

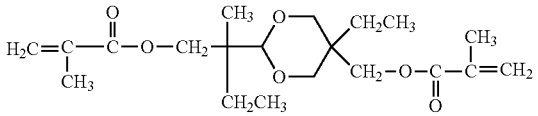

(2-17)

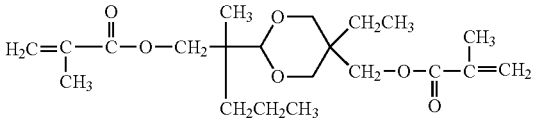

(2-18)

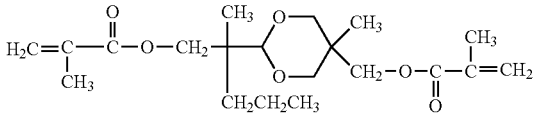

(2-19)

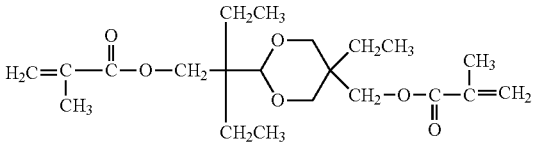

(2-20)

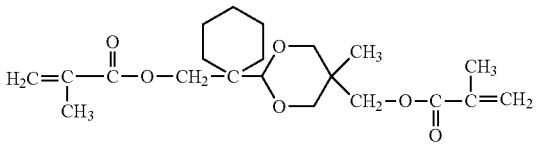

(2-21)

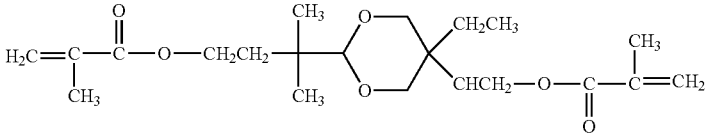

(2-22)

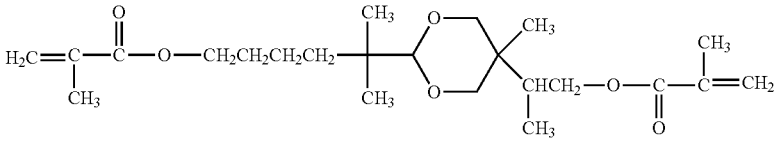

Among these, from the standpoint of reducing the formation of unevenness in an image, a compound represented by the formula (2-1) and a compound represented by the formula (2-2) are particularly preferred.

Next, synthesis examples of the compound represented by the formula (2) are described below.

Synthesis Example of Compound Represented by Formula (2)

Synthesis examples of compounds having a bifunctional polymerizable acrylic group represented by formula (2-3) are described below.

Reaction formula (1)

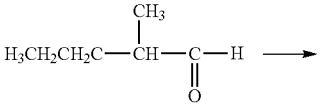

-continued

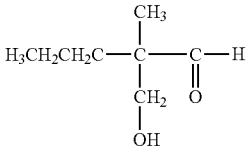

First, 50 parts of 2-methylvaleraldehyde, 40.5 parts of 37% formaldehyde, and 8.5 parts of benzyltrimethylammonium hydroxide (40% aqueous solution) were mixed in an autoclave. Then, the pressure in the autoclave was increased to 0.5 MPa by using nitrogen, and the mixture was stirred at 90° C. for 1 hour. After the completion of the reaction, the reaction solution was cooled to room temperature, and subjected to liquid-liquid separation. The reaction solution was further washed with water, and concentrated to afford about 50 parts of colorless liquid.

Reaction formula (2)

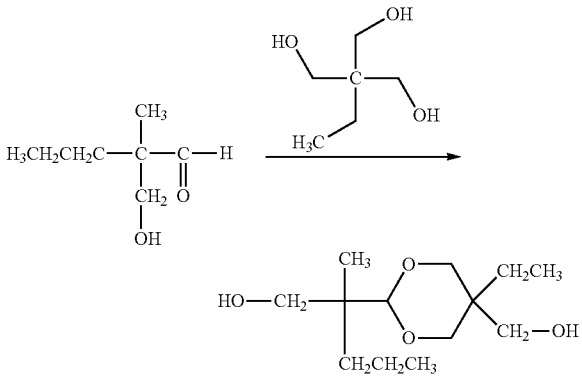

The resulting 50 parts of colorless liquid was mixed with 52 parts of trimethylolpropane and 1 part of p-toluenesulfonic acid, and the mixture was stirred at room temperature overnight. The completion of the reaction, the reaction product was purified by column chromatography (using silica gel as a stationary phase, and ethyl acetate as a mobile phase) to afford about 30 parts of a colorless oily material.

Reaction formula (3)

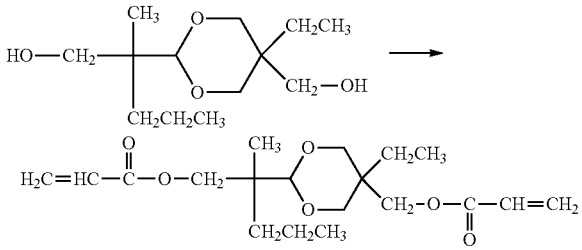

Using chloroform as a dissolvent, triethylamine as a catalyst, and dicyclohexylcarbodiimide as a dehydration condensation agent, the resulting colorless oily material was subjected to dehydration condensation with acrylic acid.

The filtrate of the reaction product was concentrated, and purified by column chromatography (using silica gel as a stationary phase, and n-hexane/ethyl acetate=4/1 as a mobile phase) to afford a colorless liquid. Further, 4-methoxyphenol was added as a polymerization inhibitor so that the concentration of 4-methoxyphenol was 100 ppm.

Accordingly, a compound represented by the formula (2-3) was obtained.

Similarly, other exemplary compounds of the compound represented by the formula (2) can be synthesized.

(Curable Hole-Transport Compound)

The content of the curable hole-transport compound in a composition for obtaining a cured product included in a surface layer preferably satisfies the following condition.

That is, in the above-described composition, when the mass of the above-described curable hole-transport compound is denoted by A, the mass of the compound represented by the above-described formula (1) is denoted by B, and the mass of the compound represented by the above-described formula (2) is denoted by C, a ratio of A, which is the mass of the curable hole-transport compound, to the sum total of A, B, and C, which is also represented as A/(A+B+C), is preferably 0.5 or more and 0.85 or less.

When A/(A+B+C) is 0.5 or more, the surface layer of the electrophotographic photosensitive member can perform an excellent hole transport properties. On the other hand, when A/(A+B+C) is 0.85 or less, the contents of a compound represented by the formula (1) and a compound represented by the formula (2), which are used together with the curable hole-transport compound, can be increased, and the effects derived from the use of these compounds can be increased.

A/(A+B+C) is more preferably 0.6 or more and 0.8 or less.

The content of the curable hole-transport compound in the surface layer is preferably 50% or more and 85% or less on a mass basis.

The curable hole-transport compound may be any compound as long as the compound performs a hole transport function and has a polymerizable functional group.

The curable hole-transport compound is preferably a compound represented by the following formula (7), which has a fluorene structure.

(7)

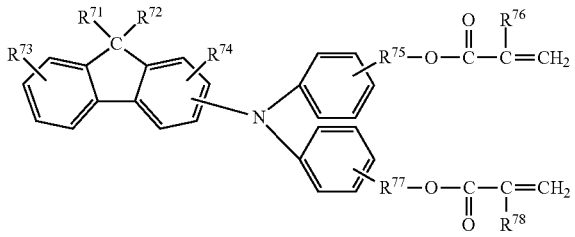

In formula (7), $R^{71}$ and $R^{72}$ each independently represent an alkyl group having 2 or more and 8 or less carbon atoms. $R^{73}$ and $R^{74}$ each independently represent a hydrogen atom or an alkyl group having 4 or less carbon atoms. $R^{75}$ and $R^{77}$ each independently represent an alkylene group having 3 or more and 6 or less carbon atoms. $R^{76}$ and $R^{78}$ each independently represent a hydrogen atom or a methyl group.

The curable hole-transport compound represented by formula (7) has substituents $R^{71}$ and $R^{72}$ which are bonded to 9-position of the so-called fluorene structure. $R^{71}$ and $R^{72}$ are each independently an alkyl group having 2 or more and 8 or less carbon atoms.

The fluorene structure is formed so that a 5-membered ring and a 6-membered ring are condensed together, and has a high planarity. On the other hand, only the carbon atom at 9-position of the fluorene structure has sp3 hybrid orbitals, and is located at a position that is out of the plane formed by the tricyclic fused ring. It is thought that, due to the location of the carbon atom, even when $R^{71}$ and $R^{72}$ have a large number of carbon atoms, the curable hole-transport compound has a structure that cannot readily inhibit the hole transport properties.

Because an alkyl group having a large number of carbon atoms is present in the vicinity of an aromatic amino group of the curable hole-transport compound, the hydrophobicity of the curable hole-transport compound is increased, and the occurrence of image deletion under a high-temperature and high-humidity environment can be effectively suppressed.

In the formula (7), it is thought that if a carbon chain that is bonded to 9-position of the fluorene structure is too long, steric hindrance to an aromatic amino group or the like becomes large and the hole transport layer becomes highly disordered, and therefore the hole transport property of the electrophotographic photosensitive member is inhibited.

Thus, the alkyl groups represented by $R^{71}$ and $R^{72}$ each have 8 or less carbon atoms, more preferably 6 or less carbon atoms, and still more preferably 2 or more and 5 or less carbon atoms. The alkyl groups represented by $R^{71}$ and $R^{72}$ are each particularly preferably a propyl group.

Examples of the alkyl group represented by $R^{71}$ and $R^{72}$ include a methyl group, an ethyl group, an n-propyl group, an isopropyl group, an n-butyl group, an isobutyl group, a sec-butyl group, a tert-butyl group, an n-pentyl group, an isopentyl group, a neopentyl group, a tert-pentyl group, a cyclopentyl group, an n-hexyl group, a 1-methylpentyl group, a 4-methyl-2-pentyl group, a 3,3-dimethylbutyl group, a 2-ethylbutyl group, a 1-methylhexyl group, a 4-tert-butylcyclohexyl group, an n-heptyl group, a 2-methylheptyl group, and an n-octyl group.

The curable hole-transport compound represented by the formula (7) may, for the purpose of improving solubility, improving compatibility with the surrounding materials, and the like, have alkyl groups each having 4 or less carbon atoms as substituents $R^{73}$ and $R^{74}$. Since $R^{73}$ and $R^{74}$ are directly bonded to a benzene ring of fluorene, when the carbon chains are too long, the carbon chains become inhibitory factors in steric hindrance or the like. Thus, the alkyl group that can be $R^{73}$ and $R^{74}$ has 4 or less carbon atoms. Examples of the alkyl group that can be $R^{73}$ and $R^{74}$ include a methyl group, an ethyl group, an n-propyl group, an isopropyl group, an n-butyl group, an isobutyl group, a sec-butyl group, and a tert-butyl group.

The curable hole-transport compound represented by the formula (7) has $R^{75}$ and $R^{77}$ between the benzene ring and the polymerizable functional group.

It is thought that this partial structure exerts an influence on the energy values of molecular orbitals of the curable hole-transport compound. In particular, among the molecular orbitals, the highest occupied molecular orbital (HOMO) relates to hole transport properties. Thus, it is important, for the hole transport properties, that HOMO has an energy value within an appropriate range.

Further, from the standpoint of injecting holes into a surface layer and transferring the holes under a specific environment that is a low-temperature and low-humidity environment, it is required that HOMO has an energy value within a specific range.

The present inventors have found that it is important that, for reducing fluctuations in bright part potential of the electrophotographic photosensitive member during successively outputting images under a low-temperature and low-humidity environment, molecular design is carried out so that the energy value of HOMO of the curable hole-transport compound represented by the formula (7) is within an appropriate range.

That is, under conditions such as low-temperature and low-humidity environment in which hole injection and transport functions may be easily suppressed, when the energy value of HOMO of the curable hole-transport compound included in a surface layer is optimized, injection of electric charges from a neighboring layer and transfer of the electric charges can be performed preferably.

It is speculated that since the curable hole-transport compound represented by the formula (7) has a fluorene structure having a widely spread two-dimensional conjugated structure and HOMO has an energy value within a specific range, a synergy effect can be exerted. The energy value of HOMO of the compound represented by the formula (7) as calculated using the density functional theory (B3LYP/6-31G*) is preferably −4.9 (eV) or more and −4.7 (eV) or less.

The alkylene group represented by $R^{75}$ and $R^{77}$ in the formula (7) has 3 or more and 6 or less carbon atoms. When the alkylene group represented by $R^{75}$ and $R^{77}$ has 3 or more carbon atoms, the energy value of HOMO of the curable hole-transport compound becomes −4.9 (eV) or more. Thus, the energy value cannot fall below the above-described appropriate range.

Since the alkylene group represented by $R^{75}$ and $R^{77}$ has 6 or less carbon atoms, an alkyl group in the vicinity of the aromatic amine structure has an appropriate length. Thus, the hole transport properties are maintained.

Examples of the alkylene group represented by $R^{71}$ and $R^{73}$ include an n-propylene group, an iso-propylene group, an n-butylene group, an iso-butylene group, a sec-butylene group, a tert-butylene group, an n-pentylene group, a 1-methyl-n-butylene group, a 2-methyl-n-butylene group, a 3-methyl-n-butylene group, a 1,1-dimethyl-n-propylene group, a 1,2-dimethyl-n-propylene group, a 2,2-dimethyl-n-propylene group, an n-hexylylene group, a 1-methyl-n-pentylene group, a 2-methyl-n-pentylene group, a 1,1-dimethyl-n-butylene group, and a 1,2-dimethyl-n-butylene group.

In the formula (7), the substitution position of an amino group on the fluorene structure is, from the standpoint of easy compound synthesis and electrical properties of a photosensitive member, is preferably so-called 2-position or 4-position of the fluorene. In particular, a structure in which an amino group is substituted at the 2-position is preferred.

Then, examples of the curable hole-transport compound represented by the formula (7) are provided below. However, the compound is not limited to the following examples.

(7-1)

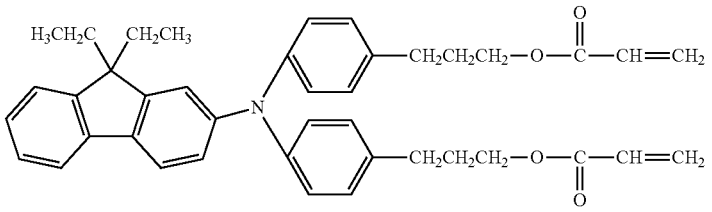

-continued
(7-2)
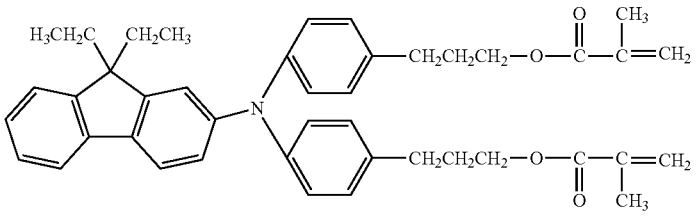
(7-3)
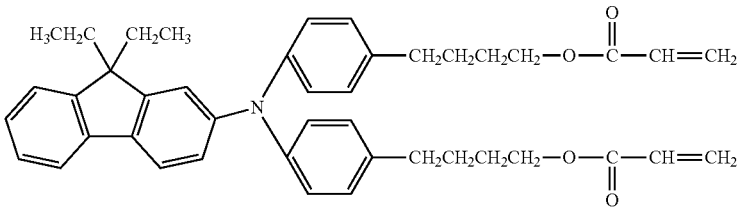
(7-4)
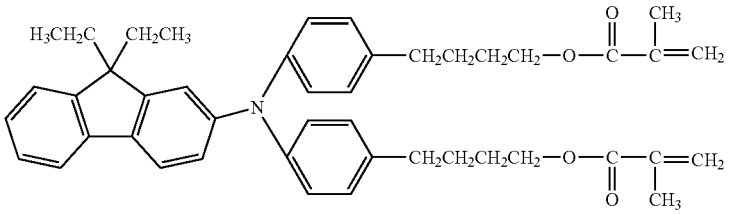
(7-5)
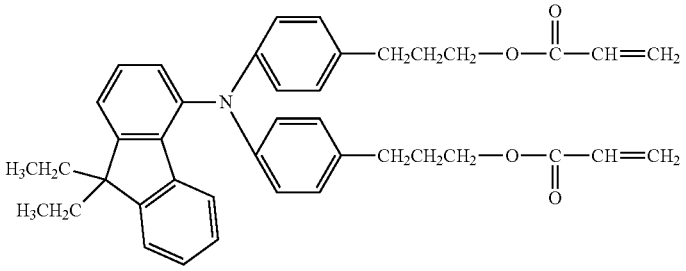
(7-6)
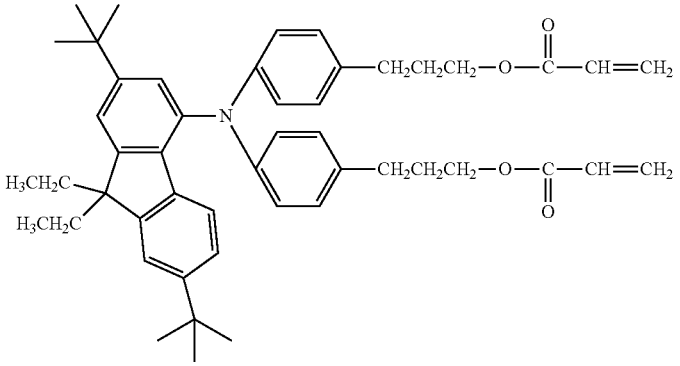
(7-7)
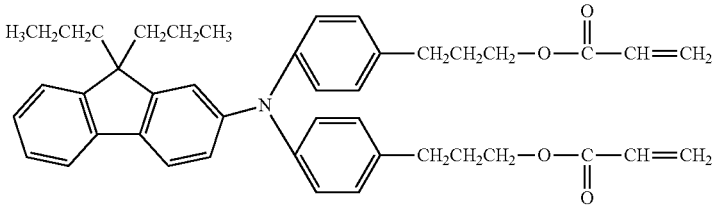

-continued
(7-8)
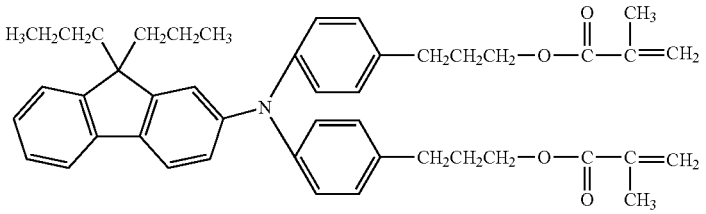
(7-9)
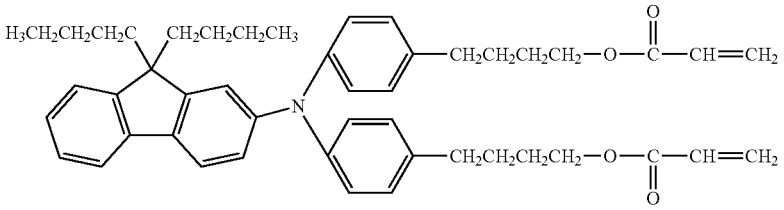
(7-10)
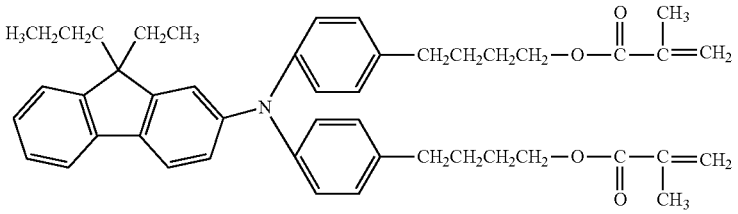
(7-11)
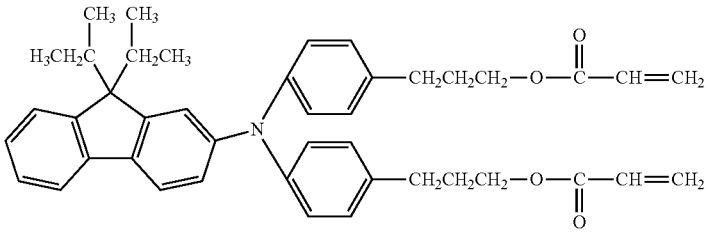
(7-12)
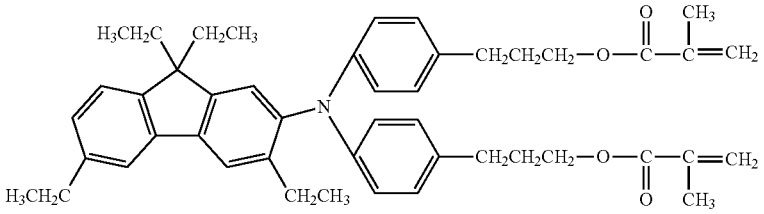
(7-13)
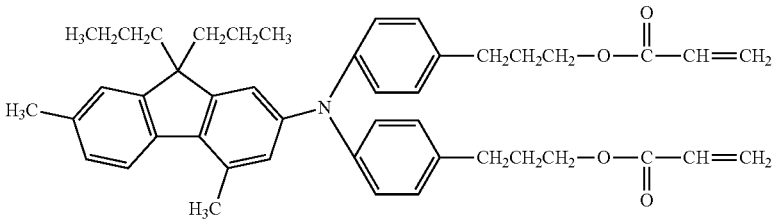
(7-14)
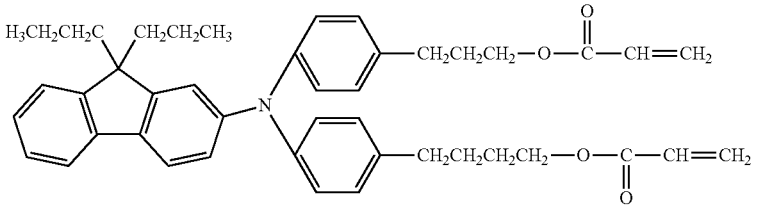

-continued
(7-15)
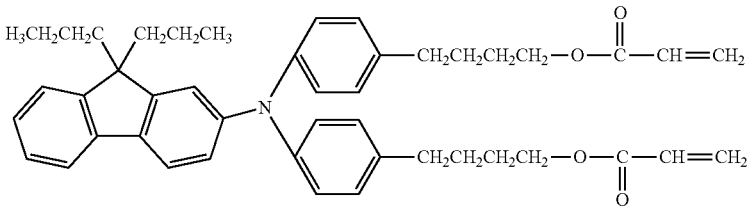
(7-16)
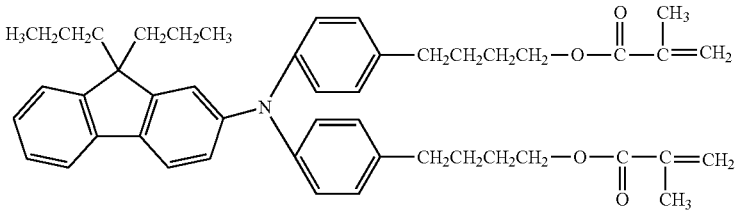
(7-17)
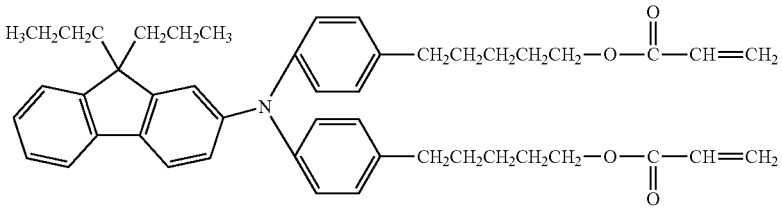
(7-18)
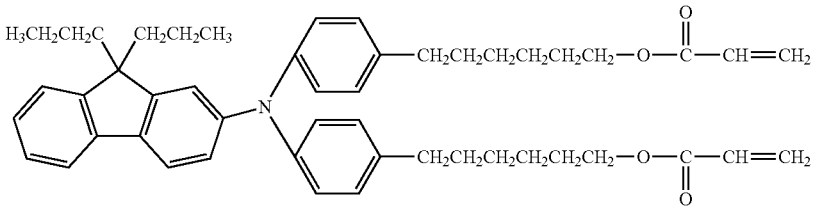
(7-19)
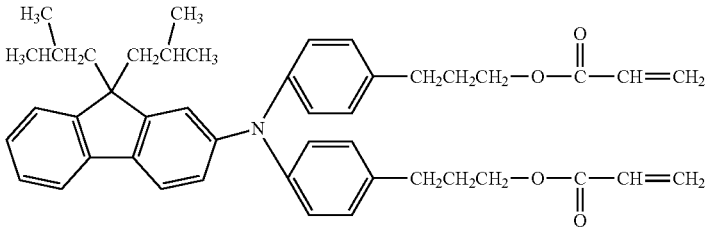
(7-20)
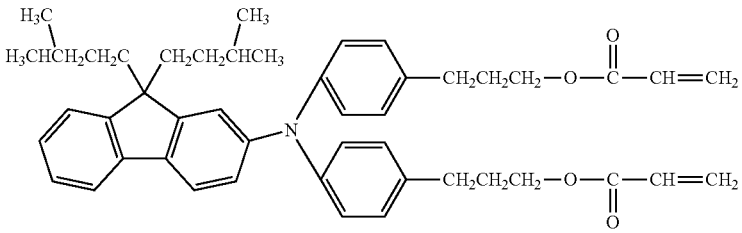
(7-21)
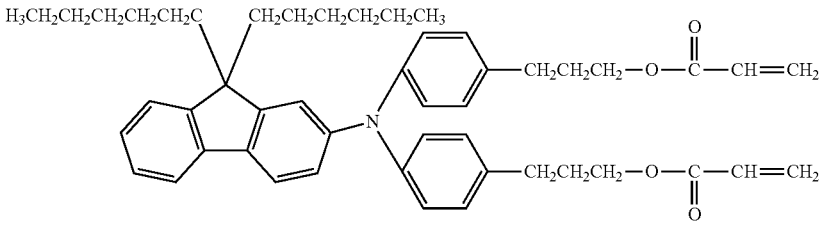

-continued (7-22)

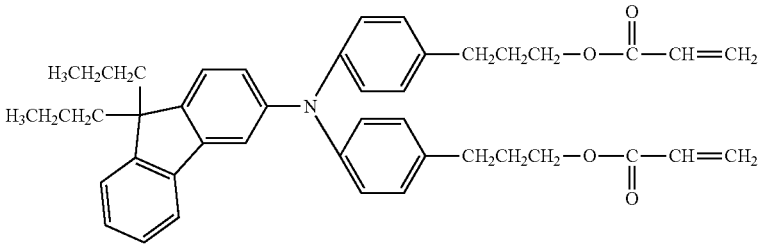

(7-23)

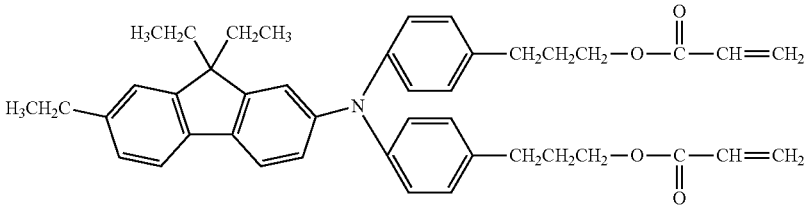

(7-24)

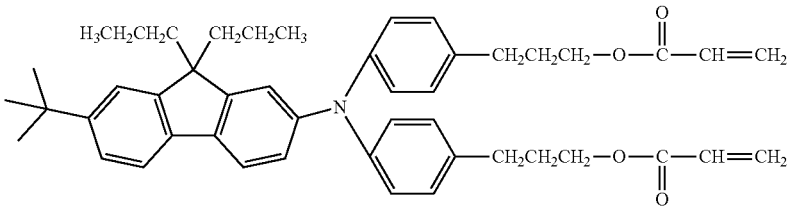

(7-25)

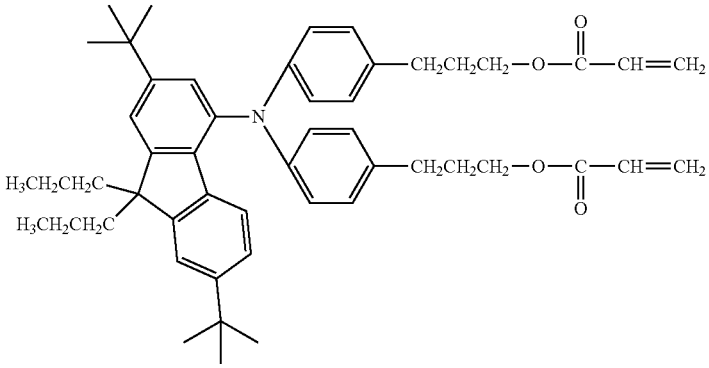

(7-26)

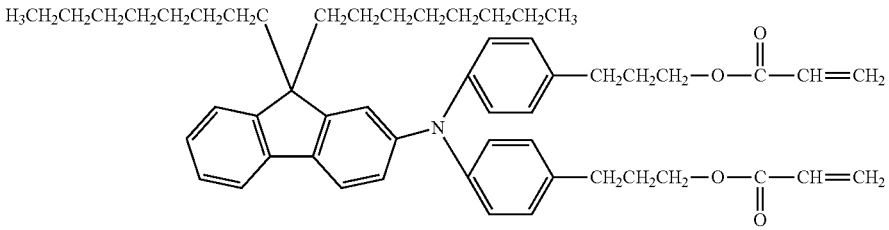

Next, representative synthesis examples of the curable hole-transport compound represented by the formula (7) are described below.

Synthesis Examples of Curable Hole-Transport Compound Represented by Formula (7)

Synthesis examples of a bifunctional curable hole-transport compound having polymerizable acrylic groups represented by the formula (7-7) are described below.

Reaction formula (1)

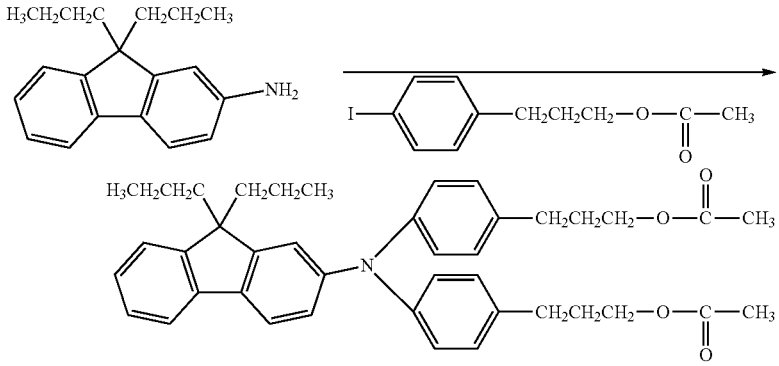

As shown in the reaction formula (4), synthesis of a triarylamine compound was performed by using an iodo compound and amine compounds. In a reaction vessel, 94.5 parts of the iodo compound, 34.5 parts of the amine compound in the reaction formula (4), and 80 parts of o-dichlorobenzene were mixed. To the mixture, 26.9 parts of potassium carbonate and 16.6 parts of copper powder were added, and the mixture was stirred at an internal temperature of 210° C. for about 24 hours to cause a reaction. After the completion of the reaction, the reaction mixture was filtered, subjected to toluene washing, and concentrated to afford a crude product.

Reaction formula (2)

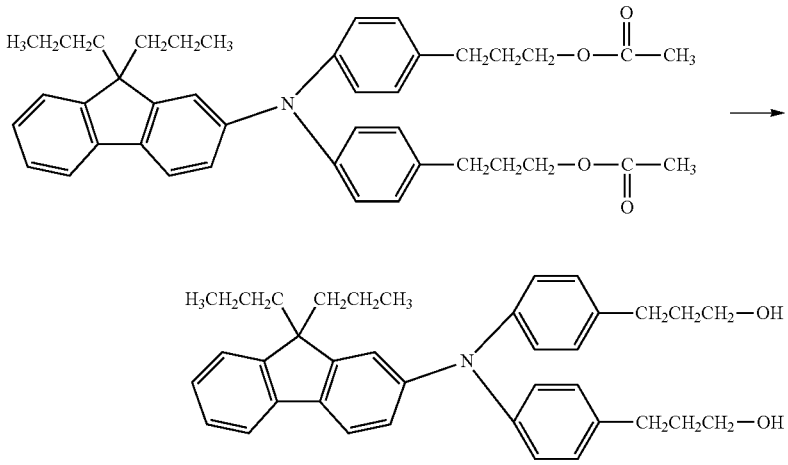

Thereafter, using all crude product obtained above, as shown in the reaction formula (5), hydrolysis of the resulting intermediate was performed to convert each of the acetate into a hydroxy group. The crude product obtained above was mixed with 100 parts of tetrahydrofuran, 100 parts of methanol, and 70 parts of a 24% sodium hydroxide aqueous solution, and the mixture was heated to an internal temperature of 60° C., stirred, and reacted for 1 hour to cause hydrolysis. After the completion of the reaction, extraction was performed with ethyl acetate, and the resulting organic layer was washed with water, washed with brine, dehydrated, and concentrated. Purification was performed by silica gel chromatography to give a dihydroxy intermediate. The amount of the resulting intermediate was 36.9 parts, and the yield (after the two-step reaction) was 53.2%.

Reaction formula (3)

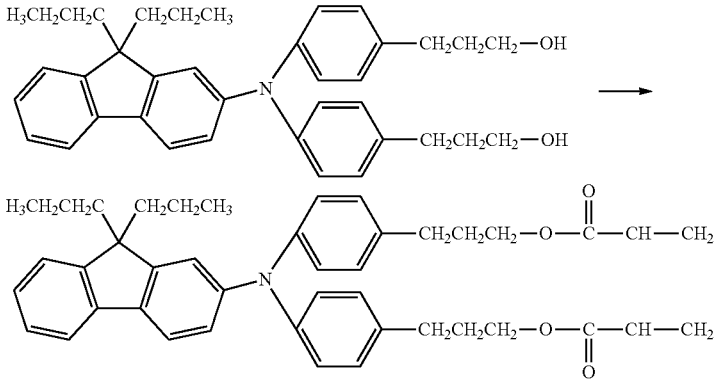

Then, 36.5 parts of the dihydroxy intermediate obtained in the above-described reaction, 365 parts of toluene, and 0.7 parts of 4-methoxyphenol were mixed, and 11.8 parts of acrylic acid was added to the reaction vessel. To the reaction vessel, 1.3 parts of p-toluenesulfonic acid monohydrate was added, heated under reflux conditions at 112° C. for 6 hours to cause, as shown in the reaction formula (6), an acylation reaction.

After the completion of the reaction, the reaction mixture was cooled and neutralized using 10% sodium hydroxide aqueous solution, and extraction was performed with ethyl acetate. The extract was washed with water, dehydrated, and concentrated to afford a crude product.

Thereafter, the crude product was purified by silica gel column chromatography to give a curable hole-transport compound represented by the formula (7-7). The amount of the resulting compound was 39.5 parts, and the yield was 63.0%.

Further, from the resulting curable hole-transport compound, by using a selected type and controlled amount of dissolvent, varnish containing the curable hole-transport compound represented by the formula (7-7) was obtained. Similarly, other exemplary compounds of the curable hole-transport compound represented by the formula (7) can be synthesized.

For carrying out polymerizing reaction of a composition containing the above-described curable hole-transport compound, the above-described compound represented by the formula (1), and the above-described compound represented by the formula (2), the followings can be used. Imparting energy, such as an ultraviolet ray, an electron beam, heat, and the like, or achieving coexistence of an auxiliary agent such as a polymerization initiator, an acid, an alkali, or a compound such as a complex.

[Electrophotographic Photosensitive Member]

The electrophotographic photosensitive member according to the present invention includes a support and a surface layer.

Examples of the method for preparing the electrophotographic photosensitive member include a method including preparing coating liquids for layers as described below, applying each of the liquid in a desired order of the layers, and drying the layers. Examples of the method for applying the coating liquid include dip coating, a spray coating method, inkjet coating, roll coating, dye coating, blade coating, curtain coating, wire bar-coating, and ring coating. Among these, from the standpoint of efficiency and productivity, dip coating is preferred.

The support and each of the layers are described below.

<Support>

In the present invention, the electrophotographic photosensitive member includes a support. In the present invention, the support is preferably an electro-conductive support having electrical conductivity. Examples of the shape of the support include a cylindrical shape, a belt-like shape, and a sheet-like shape. Among these, the cylindrical support is preferred. The surface of the support may be subjected to electrochemical treatment such as anodic oxidation, blasting treatment, cutting treatment, and the like.

Preferred examples of the material of the support include metals, resins, and glass.

Examples of the metal include aluminum, iron, nickel, copper, gold, and stainless steel, and alloys of the foregoing. Among these, the support is preferably an aluminum support using aluminum.

The resins or glass may be subjected to treatment to impart electrical conductivity. For example, the resins or glass may be mixed with or coated with an electro-conductive material to impart electrical conductivity.

<Electro-conductive Layer>

In the present invention, an electro-conductive layer may be disposed on the support. By providing an electro-conductive layer, scratches or asperities of the surface of the support can be concealed, or light reflection on the surface of the support can be regulated.

The electro-conductive layer preferably contains electro-conductive particles and a resin.

Examples of the material of the electro-conductive particles include a metal oxide, metals, and carbon black. Examples of the metal oxide include zinc oxide, aluminum oxide, indium oxide, silicon oxide, zirconium oxide, tin oxide, titanium oxide, magnesium oxide, antimony oxide, and bismuth oxide. Examples of the metal include aluminum, nickel, iron, nichrome, copper, zinc, and silver.

Among these, for use as the electro-conductive particles, a metal oxide is preferred, and, in particular, titanium oxide, tin oxide, and zinc oxide are more preferred.

When a metal oxide is used as the electro-conductive particles, the surface of the metal oxide may be treated with a silane coupling agent, or the metal oxide may be doped with an element such as phosphorus or aluminum, or an oxide thereof.

The electro-conductive particles each may have a multilayer structure including a core material and a coating layer that covers the particle. Examples of the core material include titanium oxide, barium sulfate, and zinc oxide. Examples of the coating layer include a metal oxide such as tin oxide.

When a metal oxide is used as the electro-conductive particles, the volume average particle size of the particle is preferably 1 nm or more and 500 nm or less, and more preferably 3 nm or more and 400 nm or less.

Examples of the resin include polyester resins, polycarbonate resins, polyvinyl acetal resins, acrylic resins, silicone resins, epoxy resins, melamine resins, polyurethane resins, phenol resins, and an alkyd resin.

The electro-conductive layer may further contain a masking agent such as silicone oil, resin particles, or titanium oxide.

The film thickness of the electro-conductive layer is preferably 1 μm or more and 50 μm or less, and particularly preferably 3 μm or more and 40 μm or less.

The electro-conductive layer can be formed by preparing a coating liquid for the electro-conductive layer containing the above-described various materials and a solvent, forming a coating film of the coating liquid, and drying the coating film. Examples of the solvent for use in the coating liquid include alcohol-based solvents, sulfoxide-based solvents, ketone-based solvents, ether-based solvents, ester-based solvents, and aromatic hydrocarbon-based solvents. Examples of the method for dispersing the electro-conductive particles in the coating liquid for an electro-conductive layer include a method using a paint shaker, a sand mill, a ball mill, or a liquid collision-type high speed disperser.

<Undercoat Layer>

In the present invention, an undercoat layer may be disposed on the support or the electro-conductive layer. When an undercoat layer is disposed, adhesive properties between the layers can be improved, and a charge injection suppressive effect can be imparted.

The undercoat layer preferably contains a resin. The undercoat layer may be formed as a cured film by polymerizing a composition containing a monomer having a polymerizable functional group.

Examples of the resin include polyester resins, polycarbonate resins, polyvinyl acetal resins, acrylic resins, epoxy resins, melamine resins, polyurethane resins, phenol resins, polyvinyl phenol resins, an alkyd resin, polyvinyl alcohol resins, polyethylene oxide resins, a polypropylene oxide resin, polyamide resins, polyamide-acid resins, polyimide resins, polyamide imide resins, and cellulose resins.

Examples of the polymerizable functional group of the monomer having a polymerizable functional group include an isocyanate group, a blocked isocyanate group, a methylol group, an alkylated methylol group, an epoxy group, a metal alkoxide group, a hydroxyl group, an amino group, a carboxyl group, a thiol group, carboxylic anhydride, and carbon-carbon double bonds.

In addition, the undercoat layer may, for the purpose of improving electrical properties, further include an electron transporting substance, metal oxides, metals, electro-conductive polymers, or the like. Among these, an electron transporting substance or a metal oxide is preferably used.

Examples of the electron transporting substance include quinone compounds, imide compounds, benzimidazole compounds, cyclopentadienylidene compounds, fluorenone compounds, xanthone compounds, benzophenone compounds, cyanovinyl compounds, halogenated aryl compounds, silole compounds, and boron-containing compounds. The undercoat layer may be formed as a cured film by using an electron transporting substance having a polymerizable functional group as the electron transporting substance, and copolymerizing the electron transporting substance with the above-described monomer having a polymerizable functional group.

Examples of the metal oxide include indium tin oxide, tin oxide, indium oxide, titanium oxide, zinc oxide, aluminum oxide, and silicon dioxide. Examples of the metal include gold, silver, and aluminum.

The undercoat layer may further contain additives.

The film thickness of the undercoat layer is preferably 0.1 μm or more and 50 μm or less, more preferably 0.2 μm or more and 40 μm or less and particularly preferably 0.3 μm or more and 30 μm or less.

The undercoat layer can be formed by preparing a coating liquid for the undercoat layer containing the above-described various materials and a solvent, forming a coating film of the coating liquid, and drying and/or curing the coating film. Examples of the solvent for use in the coating liquid include alcohol-based solvents, ketone-based solvents, ether-based solvents, ester-based solvents, and aromatic hydrocarbon-based solvents.

<Photosensitive Layer>

The photosensitive layer of the electrophotographic photosensitive member is largely classified into a (1) laminated-layer-type photosensitive layer and a (2) monolayer-type photosensitive layer. The (1) laminated-layer-type photosensitive layer has a charge generating layer containing a charge generating substance, and a charge transporting layer containing a charge transporting substance. The (2) monolayer-type photosensitive layer has a photosensitive layer containing both a charge generating substance and a charge transporting substance.

(1) Laminated-Layer-Type Photosensitive Layer

The laminated-layer-type photosensitive layer has a charge generating layer and a charge transporting layer.

(1-1) Charge Generating Layer

The charge generating layer preferably contains a charge generating substance and a resin.

Examples of the charge generating substance include azo pigments, perylene pigments, polycyclic quinone pigments, indigo pigments, and phthalocyanine pigments. Among these, azo pigments and phthalocyanine pigments are preferred. Among the phthalocyanine pigments, oxytitanium phthalocyanine pigments, chlorogallium phthalocyanine pigments, and hydroxygallium phthalocyanine pigments are preferred.

The content of the charge generating substance in the charge generating layer is preferably 40 mass % or more and 85 mass % or less, and more preferably 60 mass % or more and 80 mass % or less with respect to the total mass of the charge generating layer.

Examples of the resin include polyester resins, polycarbonate resins, polyvinyl acetal resins, polyvinyl butyral resins, acrylic resins, silicone resins, epoxy resins, melamine resins, polyurethane resins, phenol resins, polyvinyl alcohol resins, cellulose resins, polystyrene resins, polyvinyl acetate resins, and polyvinyl chloride resins. Among these, polyvinyl butyral resins are more preferred.

The charge generating layer may further contain additives such as antioxidants and ultraviolet absorbers. Specific examples include hindered phenol compounds, hindered amine compounds, sulfur compounds, phosphorus compounds, and benzophenone compounds.

The film thickness of the charge generating layer is preferably 0.1 μm or more and 1 μm or less, and more preferably 0.15 μm or more and 0.4 μm or less.

The charge generating layer can be formed by preparing a coating liquid for the charge generating layer containing the above-described various materials and a solvent, forming a coating film of the coating liquid, and drying the coating film. Examples of the solvent for use in the coating liquid include alcohol-based solvents, sulfoxide-based solvents, ketone-based solvents, ether-based solvents, ester-based solvents, and aromatic hydrocarbon-based solvents.

(1-2) Charge Transporting Layer

The charge transporting layer preferably contains a charge transporting substance and a resin.

Examples of the charge transporting substance include polycyclic aromatic compounds, heterocyclic compounds, hydrazone compounds, styryl compounds, enamine compounds, benzidine compounds, and triarylamine compounds, and resins each having a substituent derived from the foregoing compounds. Among these, triarylamine compounds and benzidine compounds are preferred.

The content of the charge transporting substance in the charge transporting layer is preferably 25 mass % or more and 70 mass % or less, and more preferably 30 mass % or more and 55 mass % or less with respect to the total mass of the charge transporting layer.

Examples of the resin include polyester resins, polycarbonate resins, acrylic resins, and polystyrene resins. Among these, polycarbonate resins and polyester resins are preferred. As the polyester resins, polyalylate resins are particularly preferred.

The ratio (mass ratio) between the content of the charge transporting substance and the content of the resin is preferably 4:10 to 20:10, and more preferably 5:10 to 12:10.

The charge transporting layer may contain additives such as antioxidants, ultraviolet absorbers, plasticizers, leveling agents, lubricating agents, and wear resistance-improving agents. Specific examples include hindered phenol compounds, hindered amine compounds, sulfur compounds, phosphorus compounds, benzophenone compounds, siloxane-modified resins, silicone oil, fluororesin particles, polystyrene resin particles, polyethylene resin particles, silica particles, alumina particles, and boron nitride particles.

The film thickness of the charge transporting layer is preferably 5 μm or more and 50 μm or less, more preferably 8 μm or more and 40 μm or less, and particularly preferably 10 μm or more and 30 μm or less.

The charge transporting layer can be formed by preparing a coating liquid for the charge transporting layer containing the above-described various materials and a solvent, forming a coating film of the coating liquid, and drying the coating film. Examples of the solvent for use in the coating liquid include alcohol-based solvents, ketone-based solvents, ether-based solvents, ester-based solvents, and aromatic hydrocarbon-based solvents. Among these solvents, ether-based solvents or aromatic hydrocarbon-based solvents are preferred.

When the electrophotographic photosensitive member does not have a protection layer, which will be described later, the charge transporting layer is a surface layer in the present invention. That is, the charge transporting layer includes a cured product of a composition containing the curable hole-transport compound, the compound represented by the formula (1), and the compound represented by the formula (2).

(2) Monolayer-Type Photosensitive Layer

The monolayer-type photosensitive layer can be formed by preparing a coating liquid for the photosensitive layer containing a charge generating substance, a charge transporting substance, a resin, and a solvent, forming a coating film of the coating liquid, and drying the coating film. Examples of the charge generating substance, the charge transporting substance, and the resin are the same as those materials exemplified in the above-described "(1) laminated-layer-type photosensitive layer".

The film thickness of the monolayer-type photosensitive layer is preferably 5 μm or more and 40 μm or less.

When the electrophotographic photosensitive member does not have a protection layer, which will be described later, the monolayer-type photosensitive layer is a surface layer in the present invention. That is, the monolayer-type photosensitive layer includes a cured product of a composition containing the curable hole-transport compound, the compound represented by the formula (1), and the compound represented by the formula (2).

<Protection Layer>

In the present invention, a protection layer may be disposed on the photosensitive layer. By providing a protection layer, durability can be improved. When the electrophotographic photosensitive member has a protection layer, the protection layer is a surface layer of the present invention. That is, the protection layer includes a cured product of a composition containing the curable hole-transport compound, the compound represented by the formula (1) and the compound represented by the formula (2).

The protection layer preferably contains electro-conductive particles and/or a charge transporting substance, and a resin.

Examples of the electro-conductive particles include particles of a metal oxide, such as titanium oxide, zinc oxide, tin oxide, or indium oxide.

Examples of the charge transporting substance include polycyclic aromatic compounds, heterocyclic compounds, hydrazone compounds, styryl compounds, enamine compounds, benzidine compounds, and triarylamine compounds, and resins each having a substituent derived from the foregoing compounds. Among these, triarylamine compounds and benzidine compounds are preferred.

Examples of the resin include polyester resins, acrylic resins, phenoxy resins, polycarbonate resins, polystyrene resins, phenol resins, melamine resins, and epoxy resins. Among these, polycarbonate resins, polyester resins, and acrylic resins are preferred.

The protection layer may be formed as a cured film by polymerizing a composition containing a monomer having a polymerizable functional group. Examples of the reaction for use in the polymerization include a thermal polymerization, a photopolymerization reaction, and a radiation polymerization reaction. Examples of the polymerizable functional group of the monomer having a polymerizable functional group include an acrylic group and a methacrylic group. As the monomer having a polymerizable functional group, a material having charge transportability may be used.

The protection layer may contain additives such as antioxidants, ultraviolet absorbers, plasticizers, leveling agents, lubricating agents, and wear resistance-improving agents. Specific examples include hindered phenol compounds, hindered amine compounds, sulfur compounds, phosphorus compounds, benzophenone compounds, siloxane-modified resins, silicone oil, fluororesin particles, polystyrene resin particles, polyethylene resin particles, silica particles, alumina particles, and boron nitride particles.

The film thickness of the protection layer is preferably 2 μm or more and 8 μm or less. When the film thickness is 2 μm or more, the high fineness can be maintained, and the occurrence of unevenness in an image can be prevented. When the film thickness is 8 μm or less, the hole transport properties of the protection layer does not decrease, and electrical properties are not deteriorated.

The protection layer can be formed by preparing a coating liquid for the protection layer containing the above-described various materials and a solvent, forming a coating film of the coating liquid, and curing the coating film. Examples of the solvent for use in the coating liquid include alcohol-based solvents, ketone-based solvents, ether-based solvents, sulfoxide-based solvents, ester-based solvents, and aromatic hydrocarbon-based solvents.

To each of the layers of the electrophotographic photosensitive member of the present invention, various additives can be added. Specific examples of the additives include organic pigments, organic dyes, surface conditioners for a coating film, electron transporting agents, oils, waxes, antioxidants, light absorbers, polymerization initiators, radical quenchers, organic resin fine particles, and inorganic particles.

To the surface of each of the layers of the electrophotographic photosensitive member, surface finishing may be applied using a polishing sheet, a mold member for shape transfer, a glass bead, a zirconia bead, and the like. In addition, asperities may be formed on the surface by using a constituent material of a coating liquid. When the coating liquid is applied to each of the above-described layers, any of publicly known methods such as, for example, a dip coating method, a spray coating method, a circular amount-controlling type (ring) coating method, a spin coating method, a roller coating method, a Meyer bar coating method, and a blade coating method can be used.

[Process Cartridge, Electrophotographic Apparatus]

The process cartridge according to the present invention is characterized in that the process cartridge is detachably attachable to an electrophotographic apparatus main body, and integrally supports: the above-described electrophotographic photosensitive member; and at least one unit selected from the group consisting of a charging unit, a developing unit, a transfer unit, and a cleaning unit.

An example of a configuration of the process cartridge according to the present invention is illustrated in FIG. 1. In FIG. 1, a cylindrical-shaped electrophotographic photosensitive member 1 is rotationally driven in an arrow direction at a predetermined circumferential velocity. The circumferential surface of the rotationally driven electrophotographic photosensitive member 1 is uniformly charged to a predetermined positive or negative electrical potential with a charging unit 2. Subsequently, the electrically charged circumferential surface of the electrophotographic photosensitive member 1 receives exposing light (image-exposing light) 3 emitted from an exposing unit (not shown), such as a slit exposure unit or a laser beam scanning exposure unit. Thus, electrostatic latent images corresponding to target images are formed successively on the circumferential surface of the electrophotographic photosensitive member 1. The voltage applied to the charging unit (e.g., charging roller) 2 may be any of the following: voltage including an alternating-current component superimposed on a direct-current component, and voltage including only a direct-current component.

The electrostatic latent images formed on the circumferential surface of the electrophotographic photosensitive member 1 are developed by a toner contained in a developing agent in a developing unit 4 to form toner images. Subsequently, the toner images formed and carried on the circumferential surface of the electrophotographic photosensitive member 1 are successively transferred to a transfer material (e.g., paper or an intermediate transfer body) 6 by transfer bias from a transfer unit (e.g., a transfer roller) 5. The transfer material 6 is fed synchronously with the rotation of the electrophotographic photosensitive member 1.

The surface of the electrophotographic photosensitive member 1 after the toner image has been transferred is subjected to static elimination treatment by pre-exposing light 7 emitted from a pre-exposing unit (not shown), and thereafter the surface of the electrophotographic photosensitive member 1 is cleaned by removing toner remaining after transfer with a cleaning unit 8, so that the electrophotographic photosensitive member 1 is repeatedly used for image formation. The pre-exposing unit may be used before or after the cleaning process. However, the pre-exposing unit is not necessarily required.

The electrophotographic photosensitive member 1 may be installed in an electrophotographic apparatus such as a copying machine or a laser beam printer. A plurality of constituents including the electrophotographic photosensitive member 1, the charging unit 2, the developing unit 4, and the cleaning unit 8 may be accommodated in a container and integrally supported to constitute a process cartridge 9, and the process cartridge 9 may be configured so as to be detachably attachable to the electrophotographic apparatus main body. In FIG. 1, the electrophotographic photosensitive member 1, the charging unit 2, the developing unit 4, and the cleaning unit 8 are integrally supported to constitute a process cartridge 9 that is detachably attachable to the electrophotographic apparatus main body.

In addition, the electrophotographic apparatus according to the present invention is characterized by including: the above-described electrophotographic photosensitive member; and the charging unit, the exposing unit, the developing unit, and the transfer unit.

Figure 2:
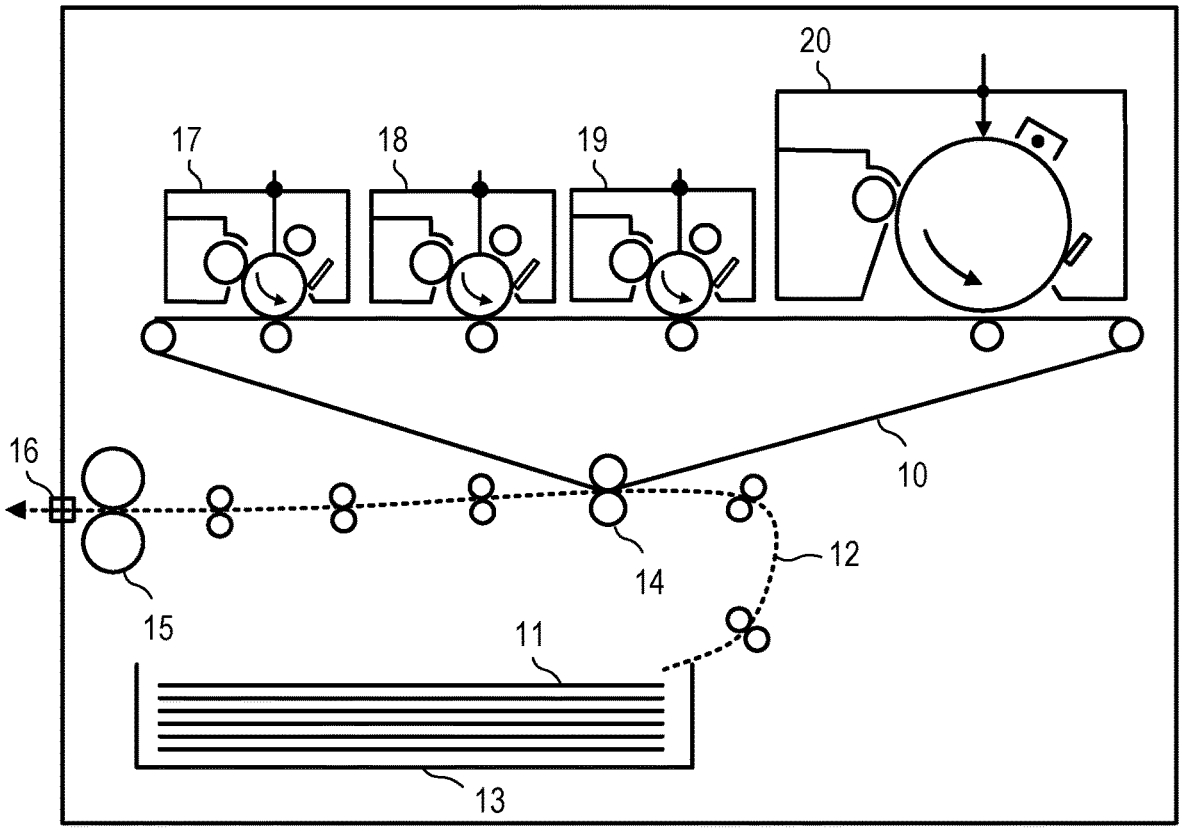
FIG. 2 is a schematic diagram illustrating an example of an electrophotographic apparatus including an electrophotographic photosensitive member.

An example of a configuration of the electrophotographic apparatus according to the present invention is illustrated in FIG. 2. A process cartridge 17 for yellow, a process cartridge 18 for magenta, a process cartridge 19 for cyan, a process cartridge 20 for black are arranged in a row along an intermediate transfer body 10. As illustrated in FIG. 2, the diameters and constituents of electrophotographic photosensitive members, the developing agent, the charging system, and other units are not necessarily the same among different colors. For example, in the electrophotographic apparatus in FIG. 2, the diameter of the electrophotographic photosensitive member for black is larger than the diameters of those for colors (yellow, magenta, and cyan). Moreover, while the charging system for colors is a system that applies voltage obtained by superimposing an alternating-current component on a direct-current component, the charging system for black is a system that uses corona discharge.

When the image forming operation is started, according to the above-described image forming process, toner images of different colors are successively stacked on the intermediate transfer body 10. In parallel, transfer paper 11 is pulled out from a paper feeding tray 13 by means of a paper feeding path 12, and fed to a secondary transfer unit 14 in conformity with the timing of rotating operation of the intermediate transfer body 10. The toner images on the intermediate transfer body 10 are transferred to the transfer paper 11 by the transfer bias from the secondary transfer unit 14. The toner images transferred on the transfer paper 11 are conveyed along the paper feeding path 12 and fixed on the transfer paper with a fixing unit 15, and the transfer paper is discharged from a paper discharge section 16.

EXAMPLES

The present invention is described in more detail below with reference to Examples and Comparative Examples. The following examples should not be construed as limiting the present invention in any way as long as the present invention does not depart from the spirit of the present invention. In the description of the following examples, the expression "part" refers to "part by mass", unless otherwise indicated.

Example 1

<Manufacture of Electrophotographic Photosensitive Member>

<Support>

As a support, a cylindrical aluminum cylinder having a diameter of 29.9 mm, a length of 357.5 mm, and a thickness of 0.7 mm was used.

<Undercoat Layer>

As a metal oxide, 100 parts by mass of zinc oxide particles (specific surface area: 19 m2/g, powder resistance: 4.7×106 Ω·cm) were mixed with 500 parts by mass of toluene with stirring. To this mixture, 0.8 parts by mass of N-2-(aminoethyl)-3-aminopropylmethyldimethoxysilane (trade name: KBM602, manufactured by Shin-Etsu Chemical Co., Ltd.) was added as a silane coupling agent, and the mixture was stirred for 6 hours. Thereafter, toluene was distilled off under reduced pressure, and the residue was heat-dried at 140° C. for 6 hours to afford surface-treated zinc oxide particles.

The above-described support was dip-coated with this coating liquid for an undercoat layer to form a coating film, and the resulting coating film was dried at 160° C. for 40 minutes to form an undercoat layer having a film thickness of 18 μm.

<Charge Generating Layer>

A sand mill using glass beads each having a diameter of 1 mm was charged with the following four materials and dispersion treatment was performed for 4 hours. Thereafter, 700 parts by mass of ethyl acetate was added to the dispersion to prepare a coating liquid for a charge generating layer.

Hydroxygallium phthalocyanine crystal (charge generating substance) having a crystal form having strong peaks at a Bragg angle 2θ±0.2° of 7.4° and 28.2° in CuKα characteristic X-ray diffraction: 20 parts by mass Polyvinyl butyral (trade name: S-LEC (registered trademark) B BX-1, manufactured by SEKISUI CHEMICAL CO., LTD.): 10 parts by mass Compound represented by the following structural formula (A): 0.2 parts by mass Cyclohexanone: 600 parts by mass The undercoat layer was dip-coated with the coating liquid for a charge generating layer, and the resulting coating film was dried at 80° C. for 15 minutes to form a charge generating layer having a film thickness of 0.18 μm.

(A)

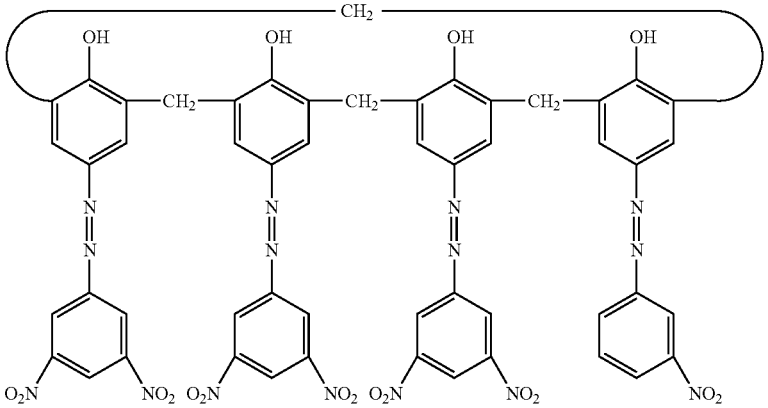

Subsequently, 15 parts by mass of polyvinyl butyral (trade name: S-LEC (registered trademark) B BM-1, manufactured by SEKISUI CHEMICAL CO., LTD.) and 15 parts by mass of blocked isocyanate (trade name: Sumidur 3175, manufactured by Sumitomo Bayer Urethane) were dissolved in a mixed solution. This mixed solution was a mixed solution of 73.5 parts by mass of methyl ethyl ketone and 73.5 parts by mass of 1-butanol.

To this solution, 80.8 parts by mass of the surface-treated zinc oxide particles prepared above and 0.4 parts by mass of 2,3,4-trihydroxybenzophenone (manufactured by Tokyo Chemical Industry Co., Ltd.) were added. The particles were dispersed with a sand mill apparatus using glass beads each having a diameter of 0.8 mm under an atmosphere of 23° C. for 3 hours. After completion of the dispersion, 0.01 parts by mass of silicone oil (trade name: SH28PA, manufactured by Dow Corning Toray Co., Ltd.) and 5.6 parts by mass of crosslinked polymethyl methacrylate (PMMA) particles (trade name: TECHPOLYMER (registered trademark) SSX-103, manufactured by SEKISUI PLASTICS CO., Ltd., average primary diameter of 3.1 μm) were added with stirring to prepare a coating liquid for an undercoat layer.

<Charge Transporting Layer>

The following five materials were dissolved in a mixed solvent of 600 parts by mass of xylene and 200 parts by mass of dimethoxymethane to prepare a coating liquid for a charge transporting layer.

Compound represented by the following structural formula (B) (charge transporting substance): 30 parts by mass Compound represented by the following structural formula (C) (charge transporting substance): 60 parts by mass Compound represented by the following structural formula (D) (charge transporting substance): 10 parts by mass Compound represented by the following structural formula (E) (Mv: 20000): 0.02 parts Polycarbonate (trade name: Iupilon (registered trademark) Z400, bisphenol Z-type polycarbonate manufactured by Mitsubishi Engineering-Plastics Corporation): 100 parts by mass (B)

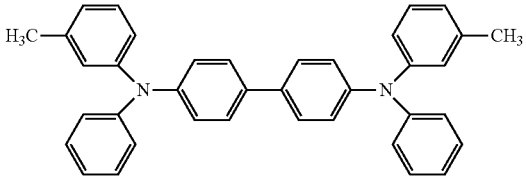

(C)

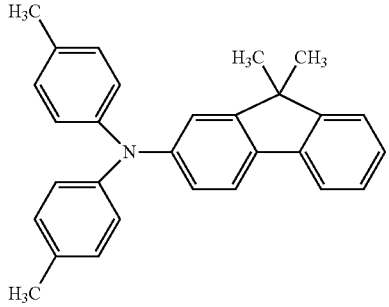

(D)

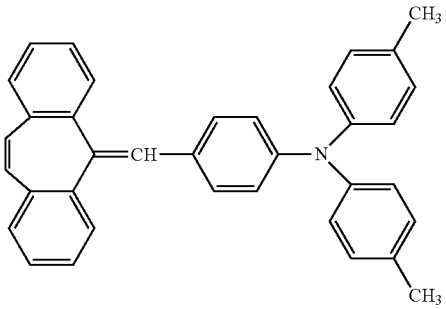

(E)

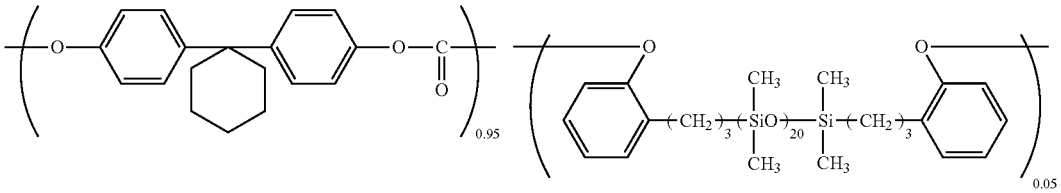

The charge generating layer was dip-coated with the coating liquid for a charge transporting layer, and the resulting coating film was dried at 110° C. for 30 minutes to form a charge transporting layer having a film thickness of 18 μm.

<Protection Layer (Surface Layer)>

Next, using materials selected from the following material group, a coating liquid for a protection layer was prepared.

First, 1.5 parts of a fluorine atom-containing acrylic resin (weight average molecular weight: 83,000, copolymerization ratio (F1)/(F2)=1/1(molar ratio)) having a repetitive structural unit represented by the following formula (F1) and a repetitive structural unit represented by the following formula (F2) was prepared.

(F1)

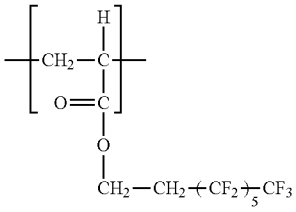

-continued (F2)

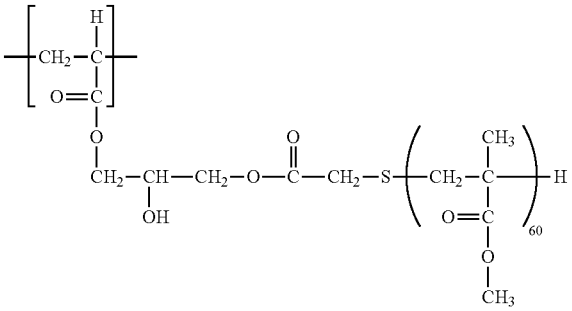

The fluorine atom-containing acrylic resin was dissolved in a mixed dissolvent of 45 parts of 1-propanol and 45 parts of ZEORORA-H (manufactured by Zeon Corporation). Then, 30 parts of fluoroethylene resin powder (trade name: Lubron L-2, manufactured by Daikin Industries, Ltd.) was added to the solution, and the fluorine atom-containing acrylic resin was dispersed with a high-pressure disperser (trade name: a microfluidizer M-110EH, manufactured by Microfluidics International Corporation, USA). Thus, an ethylene fluoride resin dispersion liquid was obtained.

Then, a coating liquid for a protection layer was prepared by mixing and uniformly dispersing the following materials.

Curable hole-transport compound represented by formula (7-7): 17.2 parts

Fluorine atom-containing monomer represented by formula (1-1): 3.7 parts

Compound represented by formula (2-2): 3.7 parts

Ethylene fluoride resin dispersion liquid: 37.8 parts 1-propanol: 19.9 parts

ZEORORA-H: 17.8 parts

The charge transporting layer was dip-coated with the coating liquid for a protection layer. The resulting coating film was dried at 50° C. for 10 minutes, and subjected to polymerization/curing treatment by electron beam irradiation and heating under the following conditions.

In an atmosphere with an oxygen content of 50 ppm or less, an aluminum cylinder was irradiated with electron beam using an electron beam irradiation apparatus under conditions with an irradiation distance of 30 mm, an acceleration voltage of 70 kV, a beam current of 8 mA, and an irradiation time of 3.0 seconds while rotated at a rotation speed of 300 rpm. Immediately after the electron beam irradiation, while the condition with an oxygen content of 50 ppm or less was maintained, the surface of the coating film of the protection layer was heated to 135° C. in 24 seconds using an induction heating apparatus.

Subsequently, the aluminum cylinder was drawn from the apparatus into ambient air, and further heated at 100° C. for 12 minutes to form a protection layer (a surface layer) having a film thickness of 5 μm.

<Shape of Surface>

Next, a pattern member (mold) was mounted in a pressure contact shape transfer processing apparatus, and the resulting electrophotographic photosensitive member before formation of recessed portions was subjected to surface processing.

Figure 3:
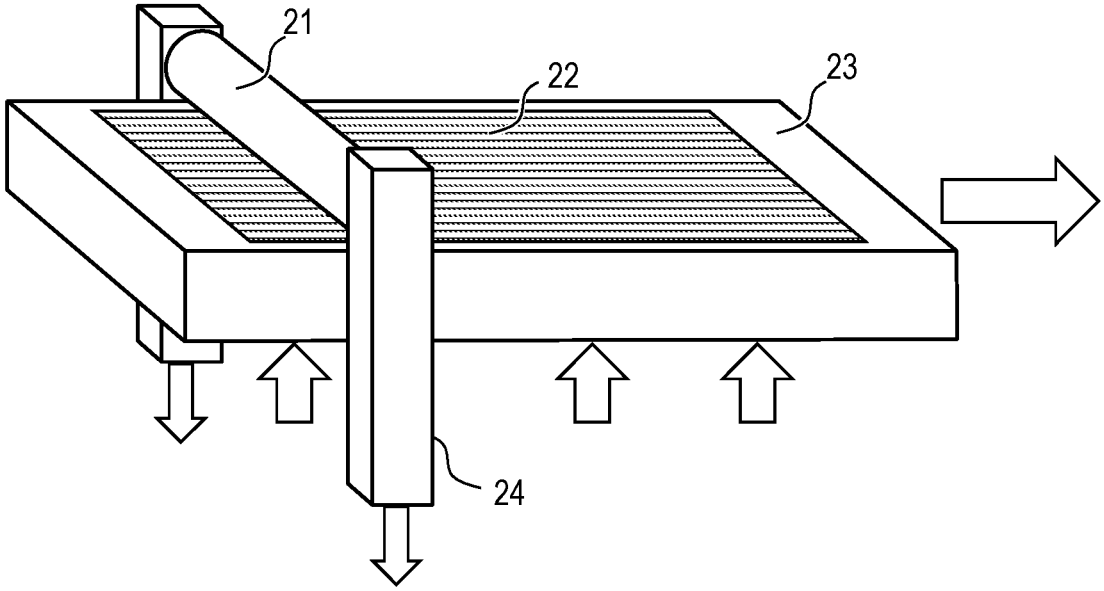
FIG. 3 is a schematic diagram illustrating an example of an apparatus for pressure contact shape transfer processing of the surface of an electrophotographic photosensitive member.
Figure 4A:
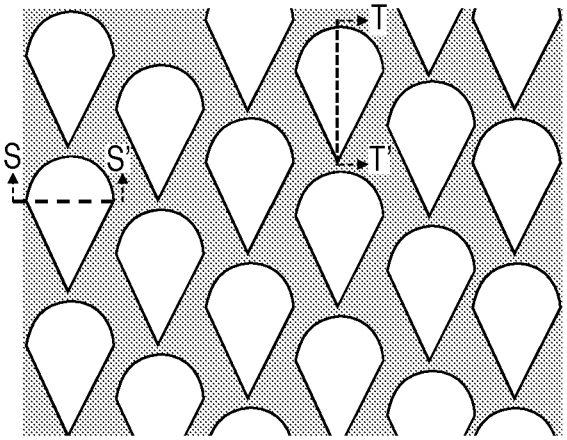
FIG. 4A is a schematic top view showing a mold.
Figure 4B:
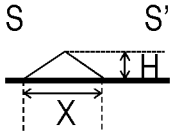
FIG. 4B is a schematic sectional view (sectional view of section S-S' in FIG. 4A) of a projected portion of the mold in the axis direction of the electrophotographic photosensitive member.
Figure 4C:
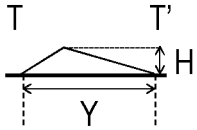
FIG. 4C is a sectional view (sectional view of section T-T' in FIG. 4A) of a projected portion of the mold in the circumferential direction of the electrophotographic photosensitive member.

Specifically, a mold illustrated in FIGS. 4A to 4C was mounted on a pressure contact shape transfer processing apparatus having almost a configuration shown in FIG. 3 including a patterned mold 22, a pressurizing member 23, and a support member 24, and the resulting electrophotographic photosensitive member 21 before formation of recessed portions was subjected to surface processing. FIGS. 4A to 4C are illustrations showing a mold used in Examples and Comparative Examples. FIG. 4A is a schematic top view of the mold, FIG. 4B is a schematic sectional view (sectional view of section S-S' in FIG. 4A) of the projected portion of the mold in the shaft direction of the electrophotographic photosensitive member 21. FIG. 4C is a sectional view (sectional view of section T-T' in FIG. 4A) of the projected portion of the mold in the circumferential direction of the electrophotographic photosensitive member 21. The mold shown in FIGS. 4A to 4C has a projected portion having a maximum width (maximum width, in the axis direction of the electrophotographic photosensitive member 21, of the projected portion on the mold viewed from above) X of 50 μm, a maximum length (maximum length, in the circumferential direction of the electrophotographic photosensitive member 21, of the projected portion on the mold viewed from above) Y of 75 μm, the area ratio of 56%, and the height H of 4 μm. Herein, the area ratio refers to a proportion of the area of the projected portion in the entire surface when the mold is viewed from above. During processing, the temperatures of the electrophotographic photosensitive member 21 and the mold were controlled so that the temperature of the surface of the electrophotographic photosensitive member 21 was 120° C. Then, the electrophotographic photosensitive member 21 was rotated in the circumferential direction while the electrophotographic photosensitive member and the pressurizing member were pressed against the mold at a pressure of 7.0 MPa, and recessed portions were formed on the entire surface of the surface layer (circumferential surface) of the electrophotographic photosensitive member 21. Thus, the electrophotographic photosensitive member 21 was produced.

The surface of the resulting an electrophotographic photosensitive member 21 was observed under magnification by using a laser microscope (trade name: X-100, manufactured by KEYENCE CORPORATION) with a 50× lens, and the recessed portions formed on the surface of the electrophotographic photosensitive member 21 was observed. In the observation, adjustment was performed so that the electrophotographic photosensitive member 21 was not inclined in the longitudinal direction, and, with respect to the circumferential direction, the top of the arc of the electrophotographic photosensitive member 21 was brought into focus. The images observed under magnification were spliced together by using an image connection application to form an image having a square region with sides of 500 μm. The resulting image was subjected to filtering processing by using attached image analysis software with a selected image processing height data using a filter type of median.

As a result of the above-described observation, the depth of the recessed portion was 2 μm, the width of the opening portion of the recessed portion in the axis direction was 50 μm, the length of the opening portion of the recessed portion in the circumferential direction was 75 μm, and the area was 140000 $\mu m^2$. Herein, the area refers to an area of the recessed portion of the surface of the electrophotographic photosensitive member 21 viewed from above, which means the area of the opening portion of the recessed portion.

Thus, an electrophotographic photosensitive member of Example 1 was prepared.

Example 2

A compound represented by the formula (1-5) was used instead of the compound represented by the formula (1-1) in Example 1. An electrophotographic photosensitive member of Example 2 was prepared as in Example 1 except for the above-described modification.

Examples 3 to 9

Types of compounds represented by the formula (1) and mass ratios among materials as shown in the following Table 1 were used instead of those in Example 1. Electrophotographic photosensitive members of Examples 3 to 9 were prepared as in Example 1 except for the above-described modifications.

In the following table, A, B, and C represent the mass of the curable hole-transport compound, the mass of the compound represented by the formula (1), and the mass of the compound represented by the formula (2), respectively.

TABLE 1

| | Compound represented by formula (1) | A/(A + B + C) | B/(A + B + C) | C/(A + B + C) | Film thickness of protection layer [μm] |
|---|---|---|---|---|---|
| Example 3 | 1-1 | 0.700 | 0.200 | 0.100 | 5 |
| Example 4 | 1-5 | 0.700 | 0.100 | 0.200 | 5 |

TABLE 1-continued

| | Compound represented by formula (1) | A/(A + B + C) | B/(A + B + C) | C/(A + B + C) | Film thickness of protection layer [μm] |
|---|---|---|---|---|---|
| Example 5 | 1-5 | 0.775 | 0.200 | 0.025 | 5 |
| Example 6 | 1-5 | 0.500 | 0.100 | 0.400 | 5 |
| Example 7 | 1-5 | 0.700 | 0.150 | 0.150 | 1 |
| Example 8 | 1-5 | 0.700 | 0.150 | 0.150 | 10 |
| Example 9 | 1-5 | 0.700 | 0.150 | 0.150 | 5 |

Example 10

In the step of preparing a coating liquid for a protection layer in Example 2, the compound represented by the formula (2-1) was used instead of the compound represented by the formula (2-2), and the following compound represented by the formula (4-1) was used instead of the curable hole-transport compound represented by the formula (7-7). An electrophotographic photosensitive member of Example 10 was prepared as in Example 2 except for the above-described modifications.

(4-1)

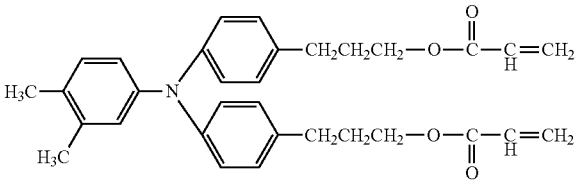

Example 11

In the step of preparing a coating liquid for a protection layer in Example 10, the following compound represented by the formula (5-1) was used instead of the compound represented by the formula (1-5). An electrophotographic photosensitive member of Example 11 was prepared as in Example 10 except for the above-described modification.

(5-1)

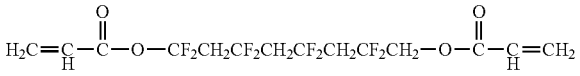

Examples 12 to 19

In the step of preparing a coating liquid for a protection layer in Example 11, mass ratios as shown in Table 2 were used instead of those in Example 11. Electrophotographic photosensitive members of Examples 12 to 19 were prepared as in Example 11 except for the above-described modifications.

TABLE 2

| | A/(A + B + C) | B/(A + B + C) | C/(A + B + C) | Film thickness of protection layer [μm] |
|---|---|---|---|---|
| Example 12 | 0.700 | 0.150 | 0.150 | 1 |
| Example 13 | 0.700 | 0.150 | 0.150 | 10 |
| Example 14 | 0.770 | 0.180 | 0.050 | 10 |
| Example 15 | 0.630 | 0.120 | 0.250 | 10 |
| Example 16 | 0.700 | 0.050 | 0.250 | 10 |
| Example 17 | 0.700 | 0.250 | 0.050 | 10 |
| Example 18 | 0.200 | 0.400 | 0.400 | 10 |
| Example 19 | 0.900 | 0.050 | 0.050 | 1 |

Comparative Example 1

An electrophotographic photosensitive member was prepared as in Example 1 except that a protection layer was formed as described below.

In the step of preparing a coating liquid for a protection layer, without using the compound represented by the formula (2), the following materials are stirred and uniformly dispersed to prepare a coating liquid for a protection layer.

Compound represented by the formula (4-1): 23.3 parts

Compound represented by the following formula (5-2): 1.2 parts

The above-described ethylene fluoride resin dispersion liquid: 37.8 parts 1-propanol: 19.9 parts ZEORORA-H (manufactured by Zeon Corporation): 17.8 parts (5-2)

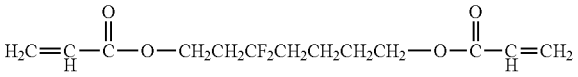

Comparative Example 2

In the step of preparing a coating liquid for a protection layer in Example 19, 0.4 parts of the compound represented by the formula (2-1) was used. An electrophotographic photosensitive member of Comparative Example 2 was prepared as in Example 19 except for the above-described modification.

Comparative Example 3

An electrophotographic photosensitive member was prepared as in Comparative Example 2 except that a protection layer was formed as described below.

A compound represented by the formula (1-1) was used instead of the compound represented by the formula (1-5) used in Comparative Example 2, and a polymerizable compound represented by the formula (6-1) was used instead of the compound represented by the formula (2-1). An electrophotographic photosensitive member of Comparative Example 3 was prepared as in Comparative Example 2 except for the above-described modification.

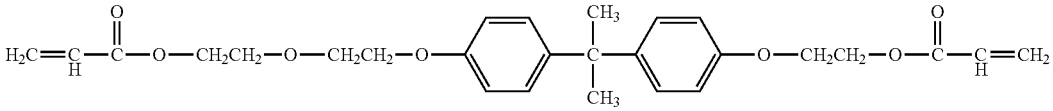

(6-1)

EVALUATIONS

Evaluation: Evaluation of Unevenness in Image

Using a photosensitive member testing apparatus (trade name: CYNTHIA59, manufactured by GENTEC CO., LTD.), electrical charging and light exposure were repeatedly applied to an electrophotographic photosensitive member of each of Examples and Comparative Examples, then an image was output by using a copying machine, and unevenness in the image was evaluated.

Specifically, an electrophotographic photosensitive member of each of Examples and Comparative Examples was installed in a photosensitive member testing apparatus, electrical charging and light exposure were applied during 1000 rotations, then the electric charging, light exposure, and rotation were stopped, and thereafter photosensitive member testing apparatus was allowed to stand for 24 hours while the corona charging apparatus and the electrophotographic photosensitive member faced each other.

Environment; temperature of 23° C., humidity of 5% RH

Electrical charging; Setting was adjusted so that the corona charging apparatus and the electrophotographic photosensitive member had a surface potential of −700 V.

Light exposure; LED having an emission wavelength of 780 nm, light quantity of 20 ($\mu J/cm^2$)

Next, the electrophotographic photosensitive member was drawn from the photosensitive member testing apparatus, installed on a cyan station of a copying machine (trade name: iR-ADVC 5560, manufactured by Canon Inc.), and a halftone image was output under an environment of 23° C. and 5% RH. In the resulting image, image density of a portion that had faced the corona charging apparatus while standing and image density of a portion that did not have faced the corona charging apparatus were measured with a spectral densitometer (trade name: X-rite 504, manufactured by X-Rite Inc.), and a difference between the image densities was calculated. The results are shown in Table 3.

Evaluation: Evaluation of Image Deletion Under High-Temperature and High-Humidity Environment As an electrophotographic apparatus for evaluation, a customized machine of a copying machine (trade name: iR-ADVC 5560, manufactured by Canon Inc.) was used. Customization was performed so that the copying machine was capable of controlling and measuring the following: the mount of light exposure of an image, the amount of electric current from the charging roller to the support of the electrophotographic photosensitive member (hereinafter, also referred to as the total electric current), the voltage applied to the charging roller, CLN linear pressure, and the like. In addition, the power supplied to heaters of the copying machine main body and cassette heaters was turned off during use.

First, the electrophotographic apparatus and the electrophotographic photosensitive member were left under an environment of a temperature of 30° C. and a humidity of 80% RH as a high-temperature and high-humidity environment for 24 hours or more, and then the electrophotographic photosensitive member of each of Examples and Comparative Examples was mounted on a cyan station of the electrophotographic apparatus.

Next, the following voltages were applied to the charging roller. The applied voltages each had a direct-current component of −700 V, a frequency of an alternating-current component of 1500 Hz, and a peak-to-peak voltage Vpp of from −400 V to −2000 V in 100-V intervals. At each applied voltage, the total electric current was measured. A graph with a horizontal axis of Vpp and a vertical axis of the total electric current was made. Then, a Vpp at which the amount of electric current that deviated from the first order approximation curve, which was obtained within Vpp range of from −400 V to −800 V, reached 100 μA (hereinafter, also referred to as an amount of discharge current) was obtained. A setting of the total electric current was adjusted so that the total electric current became the total amount of the electric current at an applied voltage that leads to an amount of discharge current of 100 μA. Then, the electric charging setting of the copying machine was adjusted so that the dark area potential was −700 V. A cyan monochrome solid image was output on A4 size plain paper, and the amount of light exposure of an image was set so that the initial density on the paper was 1.45±0.10 as measured by a spectral densitometer (trade name: manufactured by X-Rite Inc.).

An A4 sized image with a square-grid pattern having a line width of 0.1 mm and a line spacing of 10 mm was captured with a scanner, and 5000 sheets were continuously output as cyan monochrome images. After outputting the images, main power supply of the electrophotographic apparatus was turned off, and the electrophotographic apparatus was left to stand for 3 days. After standing, the main power supply of the electrophotographic apparatus was turned on, and immediately one sheet of the above-described image with a square-grid pattern was output. Image deletion of the output image was visually observed, and the image deletion was evaluated based on the following criteria.

The evaluation ranks were as follows.

Rank 6: The grid pattern image was clearly output.

Rank 5: The grid pattern image was free from abnormality.

Rank 4: The horizontal lines of the grid pattern image had been broken, but the vertical lines were free from abnormality.

Rank 3: The horizontal lines of the grid pattern image had disappeared, but the vertical lines were free from abnormality.

Rank 2: The horizontal lines of the grid pattern image had disappeared, and the vertical lines had been broken.

Rank 1: The horizontal lines of the grip pattern image had disappeared, and the vertical lines had also disappeared.

Herein, the horizontal line of the grid pattern image refers to a line parallel to the cylinder axis direction of the electrophotographic photosensitive member, and the vertical line refers to a line perpendicular to the cylinder axis direction of the electrophotographic photosensitive member. The results are shown in Table 3.

Evaluation: Fluctuations in Electrical Potential During Repetitive Use

As an electrophotographic apparatus for evaluation, a customized machine of a copying machine (trade name: iR-ADVC 5051, manufactured by Canon Inc.) was used.

First, an electrophotographic apparatus and an electrophotographic photosensitive member of each of Examples and Comparative Examples were allowed to stand under a normal-temperature and low-humidity environment of 23° C. and 5% RH for 48 hours or more, and thereafter the electrophotographic photosensitive member was installed on a black station of the electrophotographic apparatus.

The measurement of the surface potential of an electrophotographic photosensitive member was performed by removing a developing cartridge from the apparatus for evaluation, and inserting a potential analyzer to the portion instead. The potential analyzer had a constitution including an electrometric probe disposed at the developing position of a developing cartridge. The position of the electrometric probe with respect to the electrophotographic photosensitive member lies at the center of the electrophotographic photosensitive member in the generating line direction, and the gap from the surface of the electrophotographic photosensitive member was 3 mm.

The measurement of electric potential was performed as follows. First, the applied voltage was adjusted so that the initial dark area potential (Vda) was −850 V, and the amount of light exposure of an image was adjusted so that the initial bright part potential (VLa) by laser irradiation was −200 V. These operations were performed for each of the electrophotographic photosensitive members that were to be evaluated.

Next, the process cartridge was installed on the above-described apparatus for evaluation, and 10000 sheets of images were output. After outputting 10000 sheets of images, the process cartridge was replaced with the potential analyzer, and a bright part potential (VLb) after repetitive use was measured.

Then, the difference between the initial bright part potential (VLa) before paper feeding and the bright part potential (VLb) after paper feeding was calculated, and designated as a bright part potential fluctuation AVL. The results are shown in Table 3.

Evaluation: Contact Angle of Water

The contact angle of water was measured by using a contact angle meter (trade name: DM-501, manufactured by Kyowa Interface Science Co., Ltd.). On the surface of the test sample, 1.8 μL of pure water was dropped. The contact angle of water was obtained by the θ/2 method from an image of the drop taken at 1 second after landing of the drop. The contact angle of water was represented by the average of values obtained by measuring different 4 points on the surface of the test sample. The results are shown in Table 3.

Evaluation: Determination of Ratio Between Peak Heights in Infrared Absorption Spectrum An infrared absorption spectrum of the surface of an electrophotographic photosensitive member of each of Examples and Comparative Examples was measured, and ratios of peak heights at predetermined wavenumbers were obtained. The measurement was performed as follows. A layer containing the protection layer (surface layer) formed on the support was sectioned, and an infrared spectrum of the surface of the protection layer was measured by an attenuated total reflection (ATR) spectroscopy.

The infrared spectrum was measured by using an infrared spectroscopic analyzer (Frontier FT-IR system, manufactured by PerkinElmer). A germanium prism was used as a probe for the ATR method. From results of the measurement, a spectrum with a vertical axis of absorbance (A) was obtained, and ratios of peak height values of predetermined wavenumbers were calculated. The maximum value of peak height within the wavenumber range of from 1100 $cm^{-1}$ to 1125 $cm^{-1}$ was obtained from the spectrum and denoted by D, the maximum value of peak height within the wavenumber range of from 1700 $cm^{-1}$ to 1770 $cm^{-1}$ was obtained and denoted by E, and a ratio D/E was obtained. The results are shown in Table 3.

TABLE 3

| | Hole-transport compound | | Compound represented by formula (1) | | | Compound represented by formula (2) | | |
|---|---|---|---|---|---|---|---|---|
| | Compound | A/(A + B + C) | Compound | Functional group | B/(A + B + C) | Compound | C/(A + B + C) | D/E |
| Example 1 | 7-7 | 0.700 | 1-1 | Acryloyloxy group | 0.150 | 2-2 | 0.150 | 0.40 |
| Example 2 | 7-7 | 0.700 | 1-5 | Acryloyloxy group | 0.150 | 2-2 | 0.150 | 0.40 |
| Example 3 | 7-7 | 0.700 | 1-1 | Acryloyloxy group | 0.200 | 2-2 | 0.100 | 0.30 |
| Example 4 | 7-7 | 0.700 | 1-5 | Acryloyloxy group | 0.100 | 2-2 | 0.200 | 0.45 |
| Example 5 | 7-7 | 0.775 | 1-5 | Acryloyloxy group | 0.200 | 2-2 | 0.025 | 0.03 |
| Example 6 | 7-7 | 0.500 | 1-5 | Acryloyloxy group | 0.100 | 2-2 | 0.400 | 0.70 |
| Example 7 | 7-7 | 0.700 | 1-5 | Acryloyloxy group | 0.150 | 2-2 | 0.150 | 0.40 |
| Example 8 | 7-7 | 0.700 | 1-5 | Acryloyloxy group | 0.150 | 2-2 | 0.150 | 0.40 |
| Example 9 | 7-7 | 0.700 | 1-5 | Acryloyloxy group | 0.150 | 2-2 | 0.150 | 0.40 |
| Example 10 | 4-1 | 0.700 | 1-5 | Acryloyloxy group | 0.150 | 2-1 | 0.150 | 0.40 |
| Example 11 | 4-1 | 0.700 | 5-1 | Acryloyloxy group | 0.150 | 2-1 | 0.150 | 0.40 |
| Example 12 | 4-1 | 0.700 | 5-1 | Acryloyloxy group | 0.150 | 2-1 | 0.150 | 0.40 |
| Example 13 | 4-1 | 0.700 | 5-1 | Acryloyloxy group | 0.150 | 2-1 | 0.150 | 0.40 |
| Example 14 | 4-1 | 0.770 | 5-1 | Acryloyloxy group | 0.180 | 2-1 | 0.050 | 0.05 |
| Example 15 | 4-1 | 0.630 | 5-1 | Acryloyloxy group | 0.120 | 2-1 | 0.250 | 0.50 |
| Example 16 | 4-1 | 0.700 | 5-1 | Acryloyloxy group | 0.050 | 2-1 | 0.250 | 0.50 |
| Example 17 | 4-1 | 0.700 | 5-1 | Acryloyloxy group | 0.250 | 2-1 | 0.050 | 0.05 |
| Example 18 | 4-1 | 0.200 | 5-1 | Acryloyloxy group | 0.400 | 2-1 | 0.400 | 0.70 |
| Example 19 | 4-1 | 0.900 | 5-1 | Acryloyloxy group | 0.050 | 2-1 | 0.050 | 0.05 |
| Comparative Example 1 | 4-1 | 0.950 | 5-2 | Acryloyloxy group | 0.050 | — | 0.000 | 0.00 |

TABLE 3-continued

| | | | | | | | | |
|---|---|---|---|---|---|---|---|---|
| Comparative Example 2 | 4-1 | 0.900 | 5-2 | Acryloyloxy group | 0.050 | 2-1 | 0.050 | 0.05 |
| Comparative Example 3 | 4-1 | 0.900 | 1-1 | Acryloyloxy group | 0.05 | 6-1 | 0.050 | 0.05 |

| | Film thickness of protection layer [μm] | Electro photo graphic evaluation: Unevenness in image Difference in density | Image deletion [Rank] | Fluctuation in electrical potential [V] | Contact angle [°] |
|---|---|---|---|---|---|
| Example 1 | 5 | 0 | 5 | 3 | 103 |
| Example 2 | 5 | 0 | 6 | 1 | 104 |
| Example 3 | 5 | 0 | 5 | 2 | 105 |
| Example 4 | 5 | 0 | 6 | 3 | 102 |
| Example 5 | 5 | 0.002 | 6 | 4 | 101 |
| Example 6 | 5 | 0 | 6 | 8 | 98 |
| Example 7 | 1 | 0.002 | 6 | 3 | 99 |
| Example 8 | 10 | 0 | 6 | 4 | 100 |
| Example 9 | 5 | 0.003 | 6 | 4 | 95 |
| Example 10 | 5 | 0.003 | 5 | 4 | 93 |
| Example 11 | 5 | 0.003 | 4 | 4 | 92 |
| Example 12 | 1 | 0.005 | 4 | 3 | 90 |
| Example 13 | 10 | 0.004 | 4 | 9 | 92 |
| Example 14 | 10 | 0.006 | 4 | 8 | 88 |
| Example 15 | 10 | 0.004 | 4 | 12 | 89 |
| Example 16 | 10 | 0.004 | 3 | 14 | 87 |
| Example 17 | 10 | 0.007 | 4 | 12 | 87 |
| Example 18 | 10 | 0.008 | 4 | 19 | 86 |
| Example 19 | 1 | 0.008 | 3 | 18 | 88 |
| Comparative Example 1 | 10 | 0.03 | 2 | 11 | 52 |
| Comparative Example 2 | 10 | 0.04 | 1 | 19 | 64 |
| Comparative Example 3 | 10 | 0.03 | 2 | 14 | 63 |

As described above with reference to embodiments and examples, an electrophotographic photosensitive member that can reduce unevenness formed in an image during long-time use can be provided according to the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-110642, filed Jun. 13, 2019, which is hereby incorporated by reference herein in its entirety.

What is claimed is:

1. An electrophotographic photosensitive member comprising:

a support; and a surface layer, wherein the surface layer contains a cured product of a composition containing a curable hole-transport compound, a compound represented by the following formula (1), and a compound represented by the following formula (2), $$R^{12}-(Rf^{11})_n-R^{13} \quad (1)$$

in the formula (1), $Rf^{11}$ represents a divalent group having 3 or more carbon atoms and 6 or more fluorine atoms, $R^{12}$ and $R^{13}$ each independently represent a hydrogen atom, a fluorine atom, an acryloyloxy group, or a methacryloyloxy group, with the proviso that at least one of $R^{12}$ and $R^{13}$ is an acryloyloxy group or a methacryloyloxy group, (2)

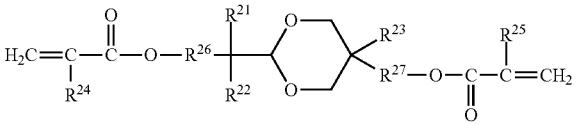

in the formula (2), $R^{21}$ and $R^{22}$ each independently represent an alkyl group having 1 or more and 4 or less carbon atoms, or a substituted or unsubstituted aryl group having 1 or more and 4 or less carbon atoms, the substituent, which can be a substituent of the aryl group, is an alkyl group having 1 or more and 4 or less carbon atoms, $R^{21}$ and $R^{22}$ may be joined together to form a ring, $R^{23}$ represents an alkyl group having 1 or more and 4 or less carbon atoms, $R^{24}$ and $R^{25}$ each independently represent a hydrogen atom or a methyl group, and $R^{26}$ and $R^{27}$ each independently represent an alkylene group having 1 or more and 4 or less carbon atoms.

2. The electrophotographic photosensitive member according to claim 1, wherein, in the composition, when the mass of the curable hole-transport compound is denoted by A, the mass of the compound represented by the formula (1) is denoted by B, and the mass of the compound represented by the formula (2) is denoted by C, a ratio of A to the sum total of A, B, and C, which is A/(A+B+C), is 0.5 or more and 0.85 or less.

3. The electrophotographic photosensitive member according to claim 1, wherein, in the composition, when the mass of the curable hole-transport compound is denoted by A, the mass of the compound represented by the formula (1) is denoted by B, and the mass of the compound represented by the formula (2) is denoted by C, a ratio of B to the sum total of A, B, and C, which is B/(A+B+C), is 0.1 or more and 0.2 or less.

4. The electrophotographic photosensitive member according to claim 1, wherein, in the composition, when the mass of the curable hole-transport compound is denoted by A, the mass of the compound represented by the formula (1) is denoted by B, and the mass of the compound represented by the formula (2) is denoted by C, a ratio of C to the sum total of A, B, and C, which is C/(A+B+C), is 0.1 or more and 0.2 or less.

5. The electrophotographic photosensitive member according to claim 1, wherein the surface layer is a protection layer, and the film thickness of the protection layer is 2 μm or more and 8 μm or less.

6. The electrophotographic photosensitive member according to claim 1, wherein in an infrared spectrum obtained for the surface layer, when the maximum value of peak height within the wavenumber range of from 1100 $cm^{-1}$ to 1125 $cm^{-1}$ is denoted by D, and the maximum value of peak height within the wavenumber range of from 1700 $cm^{-1}$ to 1770 $cm^{-1}$ is denoted by E, the ratio of D to E, which is D/E, is 0.30 or more and 0.45 or less.

7. The electrophotographic photosensitive member according to claim 1, wherein the compound represented by the formula (1) is a compound represented by the following formula (3), or a compound represented by the following formula (4), $$(R^{34})-(R^{32})-(Rf^{31})-(R^{33})-(R^{35}) \quad (3)$$

in the formula (3), $Rf^{31}$ represents a group in which 6 or more hydrogen atoms in the alkylene group are each substituted with a fluorine atom, $R^{32}$ and $R^{33}$ represent an alkylene group or a phenylene group, $R^{34}$ and $R^{35}$ are a hydrogen atom, a fluorine atom, a group represented by the following formula (5), or a group represented by the following formula (6), with the proviso that at least one of $R^{34}$ and $R^{35}$ is a group represented by the following formula (5) or a group represented by the following formula (6), $$(R^{44})-(Rf^{42})-(R^{41})-(Rf^{43})-(R^{45}) \quad (4)$$

in the formula (4), $R^{41}$ represents an alkylene group or a phenylene group, $Rf^{42}$ and $Rf^{43}$ each represent a group in which 3 or more hydrogen atoms in the alkylene group are each substituted with a fluorine atom, $R^{44}$ and $R^{45}$ represent a hydrogen atom, a fluorine atom, a group represented by the following formula (5), or a group represented by the following formula (6), with the proviso that at least one of $R^{44}$ and $R^{45}$ is a group represented by the following formula (5) or a group represented by the following formula (6), (5)

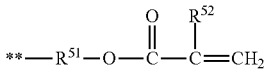

in the formula (5), the symbol ** represents a position at which the group is bonded to each of $R^{32}$, $R^{33}$, $R^{42}$, and $R^{43}$, $R^{51}$ represents a single bond or an alkylene group having 1 or more and 6 or less carbon atoms, and $R^{52}$ represents a hydrogen atom or a methyl group, (6)

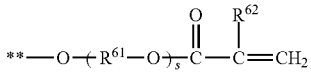

in the formula (6), the symbol ** represents a position at which the group is bonded to each of $R^{32}$, $R^{33}$, $R^{42}$, and $R^{43}$, $R^{61}$ represents an alkylene group having 1 or more and 6 or less carbon atoms, $R^{62}$ represents a hydrogen atom or a methyl group, and subscript s represents an integer of 0 or more and 4 or less.

8. The electrophotographic photosensitive member according to claim 1, wherein the curable hole-transport compound is a compound represented by the following formula (7):

(7)

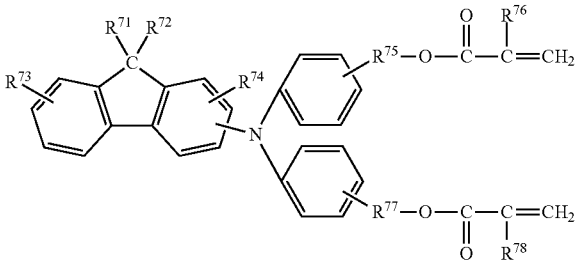

in the formula (7), $R^{71}$ and $R^{72}$ each independently represent an alkyl group having 2 or more and 8 or less carbon atoms, $R^{73}$ and $R^{74}$ each independently represent a hydrogen atom or an alkyl group having 4 or less carbon atoms, $R^{75}$ and $R^{77}$ each independently represent an alkylene group having 3 or more and 6 or less carbon atoms, and $R^{76}$ and $R^{78}$ each independently represent a hydrogen atom or a methyl group.

9. The electrophotographic photosensitive member according to claim 1, wherein at least one of $R^{21}$ and $R^{22}$ in the compound represented by the formula (2) is an alkyl group having 2 or more carbon atoms.

10. A process cartridge that is detachably attachable to an electrophotographic apparatus main body, and integrally supports:

an electrophotographic photosensitive member; and at least one unit selected from the group consisting of a charging unit, a developing unit, a transfer unit, and a cleaning unit, wherein the electrophotographic photosensitive member comprises a support and a surface layer, the surface layer includes a cured product of a composition containing a curable hole-transport compound, a compound represented by the following formula (1), and a compound represented by the following formula (2), (1)

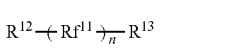

in the formula (1), $Rf^{11}$ represents a divalent group having 3 or more carbon atoms and 6 or more fluorine atoms, $R^{12}$ and $R^{13}$ each independently represent a hydrogen atom a fluorine atom, an acryloyloxy group, or a methacryloyloxy group, with the proviso that at least one of $R^{12}$ and $R^{13}$ is an acryloyloxy group or a methacryloyloxy group, (2)

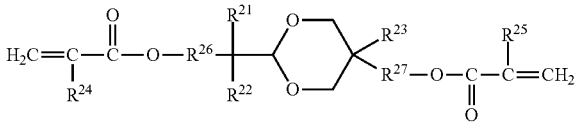

in the formula (2), $R^{21}$ and $R^{22}$ each independently represent an alkyl group having 1 or more and 4 or less carbon atoms or a substituted or unsubstituted aryl group having 1 or more and 4 or less carbon atoms, a substituent, which can be a substituent of the aryl group, is an alkyl group having 1 or more and 4 or less carbon atoms, $R^{21}$ and $R^{22}$ may be joined together to form a ring, $R^{23}$ represents an alkyl group having 1 or more and 4 or less carbon atoms, $R^{24}$ and $R^{25}$ each independently represent a hydrogen atom or a methyl group, and $R^{26}$ and $R^{27}$ each independently represent an alkylene group having 1 or more and 4 or less carbon atoms.

11. An electrophotographic apparatus, comprising: an electrophotographic photosensitive member; and a charging unit, an exposing unit, a developing unit, and a transfer unit, wherein the electrophotographic photosensitive member comprises a support and a surface layer, the surface layer includes a cured product of a composition containing a curable hole-transport compound, a compound represented by the following formula (1), and a compound represented by the following formula (2), (1)

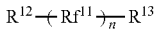

in the formula (1), $Rf^{11}$ represents a divalent group having 3 or more carbon atoms and 6 or more fluorine atoms, $R^{12}$ and $R^{13}$ each independently represent a hydrogen atom, a fluorine atom, an acryloyloxy group, or a methacryloyloxy group, with the proviso that at least one of $R^{12}$ and $R^{13}$ is an acryloyloxy group or a methacryloyloxy group, (2)

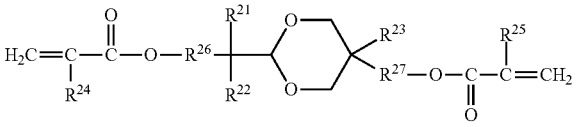

in the formula (2), $R^{21}$ and $R^{22}$ each independently represent an alkyl group having 1 or more and 4 or less carbon atoms, or a substituted or unsubstituted aryl group having 1 or more and 4 or less carbon atoms, a substituent, which can be a substituent of the aryl group, is an alkyl group having 1 or more and 4 or less carbon atoms, $R^{21}$ and $R^{22}$ may be joined together to form a ring, $R^{23}$ represents an alkyl group having 1 or more and 4 or less carbon atoms, $R^{24}$ and $R^{25}$ each independently represent a hydrogen atom or a methyl group, and $R^{26}$ and $R^{27}$ each independently represent an alkylene group having 1 or more and 4 or less carbon atoms.

* * * * *